US008272187B2

(12) United States Patent
Meersseman et al.

(10) Patent No.: US 8,272,187 B2
(45) Date of Patent: Sep. 25, 2012

(54) FLOOR PANEL, AS WELL AS METHOD, DEVICE AND ACCESSORIES FOR MANUFACTURING SUCH FLOOR PANEL

(75) Inventors: Laurent Meersseman, Kortrijk (BE); Christian Vandevoorde, Zulte (BE); Bernard Thiers, Oostrozebeke (BE)

(73) Assignee: Flooring Industries Limited, SARL, Bertrange (LU)

( * ) Notice: Subject to any disclaimer, the term of this patent is extended or adjusted under 35 U.S.C. 154(b) by 138 days.

(21) Appl. No.: 12/566,097

(22) Filed: Sep. 24, 2009

(65) Prior Publication Data

US 2010/0243138 A1 Sep. 30, 2010

Related U.S. Application Data

(63) Continuation of application No. 11/315,290, filed on Dec. 23, 2005.

(60) Provisional application No. 60/690,866, filed on Jun. 16, 2005.

(30) Foreign Application Priority Data

Dec. 23, 2004 (BE) ..... 2004/0635

(51) Int. Cl.

| | |
|---|---|
| ***E04B 1/00*** | (2006.01) |
| ***E04G 21/00*** | (2006.01) |
| ***E04G 23/00*** | (2006.01) |
| ***E04D 1/00*** | (2006.01) |
| ***B27H 1/00*** | (2006.01) |
| ***B27M 1/00*** | (2006.01) |

(52) U.S. Cl. ..... 52/745.19; 52/534; 144/358

(58) Field of Classification Search ..... 52/390, 52/392, 534, 745.19; 144/358, 359; 428/44, 428/57, 58, 60, 106, 327, 542.2; 156/228
See application file for complete search history.

(56) References Cited

U.S. PATENT DOCUMENTS

| | | | |
|---|---|---|---|
| 444,042 | A | 1/1891 | Brock |
| 457,788 | A | 8/1891 | McKenzie |
| 998,203 | A | 7/1911 | Rivers |
| 1,024,355 | A | 4/1912 | Owens |
| 1,539,148 | A | 5/1925 | Sylvester |
| 3,474,706 | A | 10/1969 | Wheeler |
| 4,237,087 | A | 12/1980 | Jones |
| 4,486,371 | A | 12/1984 | Caliri |
| 5,596,912 | A | 1/1997 | Laurence et al. |
| 5,755,068 | A | 5/1998 | Ormiston |
| 5,804,285 | A | 9/1998 | Kobayashi et al. |
| 6,401,415 | B1 | 6/2002 | Garcia |
| 6,465,046 | B1 | 10/2002 | Hansson et al. |
| 6,536,178 | B1 | 3/2003 | Palsson et al. |
| 6,565,761 | B1 | 5/2003 | Kesper |

(Continued)

FOREIGN PATENT DOCUMENTS

| | | |
|---|---|---|
| DE | 1 045 864 | 9/1953 |

(Continued)

*Primary Examiner* — Joshua J Michener
*Assistant Examiner* — Andrew Triggs
(74) *Attorney, Agent, or Firm* — Bacon & Thomas, PLLC

(57) ABSTRACT

Floor panel, more particularly a laminate floor panel, wherein this floor panel comprises a decor, a top layer on the basis of synthetic material, and an underlying substrate (13), whether or not composed of several layers or parts, wherein the floor panel (1), in the surface over which the decor (10) extends, is provided with embossed portions.

30 Claims, 12 Drawing Sheets

U.S. PATENT DOCUMENTS

Figure 1:
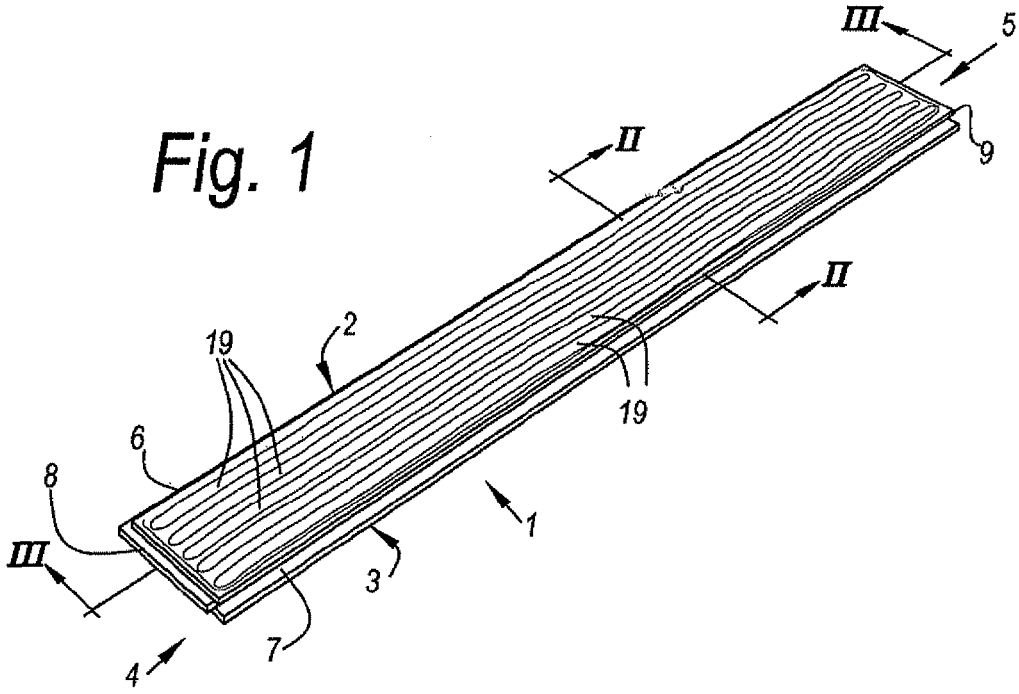

| | | | | |
|---|---|---|---|---|
| 6,786,019 | B2 * | 9/2004 | Thiers | 52/589.1 |
| 6,888,147 | B1 | 5/2005 | Hansson et al. | |
| 6,908,585 | B2 | 6/2005 | Wright et al. | |
| 6,908,663 | B1 | 6/2005 | Wright et al. | |
| 6,928,779 | B2 | 8/2005 | Moriau et al. | |
| 6,931,811 | B2 * | 8/2005 | Thiers | 52/592.1 |
| 6,955,020 | B2 | 10/2005 | Moriau et al. | |
| 6,991,830 | B1 | 1/2006 | Hansson et al. | |
| 6,993,877 | B2 | 2/2006 | Moriau et al. | |
| 7,003,364 | B1 | 2/2006 | Hansson et al. | |
| 7,055,290 | B2 * | 6/2006 | Thiers | 52/592.2 |
| 7,081,291 | B2 | 7/2006 | Courtoy et al. | |
| 7,090,910 | B2 | 8/2006 | Courtoy et al. | |
| 7,243,469 | B2 | 7/2007 | Miller et al. | |
| 7,249,445 | B2 * | 7/2007 | Thiers | 52/592.1 |
| 7,380,383 | B2 | 6/2008 | Olofsson et al. | |
| 7,632,561 | B2 * | 12/2009 | Thiers | 428/151 |
| 2002/0014047 | A1 | 2/2002 | Thiers | |
| 2002/0046528 | A1 | 4/2002 | Pervan et al. | |
| 2002/0100231 | A1 * | 8/2002 | Miller et al. | 52/177 |
| 2002/0189183 | A1 * | 12/2002 | Ricciardelli | 52/390 |
| 2003/0046892 | A1 | 3/2003 | Albany et al. | |
| 2003/0138617 | A1 | 7/2003 | Courtoy et al. | |
| 2003/0138618 | A1 | 7/2003 | Courtoy et al. | |
| 2003/0159385 | A1 * | 8/2003 | Thiers | 52/311.1 |
| 2003/0180509 | A1 | 9/2003 | Wright et al. | |
| 2003/0208980 | A1 | 11/2003 | Miller et al. | |
| 2004/0108625 | A1 * | 6/2004 | Moder et al. | 264/510 |
| 2004/0126550 | A1 | 7/2004 | Grafenauer | |
| 2005/0025934 | A1 | 2/2005 | Thiers | |
| 2005/0069681 | A1 | 3/2005 | Wright et al. | |
| 2005/0076598 | A1 * | 4/2005 | Lewark | 52/591.4 |
| 2005/0079323 | A1 | 4/2005 | Miller et al. | |
| 2005/0281993 | A1 | 12/2005 | Hansson et al. | |
| 2006/0010820 | A1 | 1/2006 | Schwitte et al. | |
| 2006/0048474 | A1 | 3/2006 | Pervan et al. | |
| 2006/0123731 | A1 | 6/2006 | Eisermann | |
| 2006/0130421 | A1 | 6/2006 | Nollet et al. | |
| 2006/0136083 | A1 | 6/2006 | Hansson et al. | |
| 2006/0156672 | A1 | 7/2006 | Laurent et al. | |
| 2006/0179773 | A1 * | 8/2006 | Pervan | 52/592.1 |
| 2006/0194015 | A1 | 8/2006 | Sabater et al. | |
| 2009/0038256 | A1 * | 2/2009 | Thiers | 52/747.11 |
| 2009/0155612 | A1 * | 6/2009 | Pervan et al. | 428/498 |

FOREIGN PATENT DOCUMENTS

| | | | | |
|---|---|---|---|---|
| DE | 1 646 248 | | | 7/1971 |
| DE | 27 04 106 | | | 8/1978 |
| DE | 33 32 617 | | | 4/1984 |
| DE | 203 11 569 | | | 11/2003 |
| DE | 203 15 676 | | | 1/2004 |
| DE | 203 17 527 | | | 2/2004 |
| EP | 0 266 622 | | | 5/1988 |
| EP | 0 528 059 | | | 2/1993 |
| EP | 747 241 | B1 | | 3/2002 |
| EP | 1 197 351 | | | 4/2002 |
| EP | 1 498 262 | | | 1/2005 |
| JP | 8-25569 | A | | 1/1985 |
| JP | 08025569 | A | * | 1/1996 |
| JP | 2000-43495 | | | 2/2000 |
| JP | 2000-71691 | A | | 3/2000 |
| JP | 2001287208 | | * | 10/2001 |
| JP | 2003200405 | A | * | 7/2003 |
| JP | 200574682 | | * | 3/2005 |
| RU | 2 082 595 | | | 6/1997 |
| WO | WO 97/47834 | | | 12/1997 |
| WO | WO 01/96689 | | | 12/2001 |
| WO | WO 02/058924 | | | 8/2002 |
| WO | WO 03/078761 | | | 9/2003 |
| WO | WO 2004/024432 | | | 3/2004 |
| WO | WO 2004/063491 | | | 7/2004 |
| WO | WO 2005/010296 | | * | 2/2005 |
| WO | WO 2009141743 | A1 | * | 11/2009 |

* cited by examiner

FLOOR PANEL, AS WELL AS METHOD, DEVICE AND ACCESSORIES FOR MANUFACTURING SUCH FLOOR PANEL

This application is a continuation of U.S. application Ser. No. 11/315,290, filed Dec. 23, 2005, which claims the benefit of U.S. provisional patent application 60/690,866, filed Jun. 16, 2005 under 35 U.S.C. 119(e) of which the full contents of the provisional application is incorporated in this application by reference.

BACKGROUND

A. Field

This invention relates to a floor panel, as well as a method, a device and accessories for manufacturing such floor panel.

B. Related Art

Thereby, it also relates to a number of methods that can be applied indirectly in the manufacturing process of the floor panels, such as etching techniques, which are particularly suited for realizing press plates that can be applied when manufacturing floor panels, whereby these etching techniques, according to the present invention, however, are not limited to this field of application.

More particularly, the invention relates to floor panels of the type which, at least at two opposite edges, is provided with coupling parts, whereby this floor panel comprises a printed decor, a top layer, more particularly a laminate layer on the basis of synthetic material, and an underlying substrate, whether or not composed of several layers or parts. Examples thereof are known, amongst others, from the patent documents WO 97/47834, WO 01/96689, WO 02/058924, WO 2004/063491 and DE 20 317 527. More particularly, it relates to floor panels for forming a floating floor covering.

It is known that in the upper side of such floor panel, a relief can be provided by means of embossments that are provided in the synthetic material-based laminate layer, whereby this mostly takes place by using a press plate provided with a relief. So, it is known, for example, from WO 01/96689, how wood structures, more particularly wood pores, can be imitated by means of embossments, whereas it is known from WO 02/058924 to imitate also deeper situated joints in a tile decor by means of embossments.

The present invention in general aims at a floor panel of the aforementioned type, whereby, by the application of well-defined technical characteristics, amongst others, a broader range of application possibilities is created and/or better imitations of wood floors or stone floors or the like can be realized and/or improved floor panels can be obtained.

SUMMARY OF THE INVENTION

According to a preferred form of embodiment, the present invention aims at a floor panel having technical characteristics allowing to imitate a floor of so-called "scraped wood" more optimally than this is possible up to date.

To this aim, the present invention, according to a first aspect, relates to a floor panel, more particularly a laminate floor panel, which, at least at two opposite edges, is provided with coupling parts, whereby this floor panel, at its decorative side, forms an imitation of wood, from which wood parts have been removed from the surface by means of a tool, more particularly, forms an imitation of so-called scraped wood, and whereby this floor panel comprises a decor representing a wood pattern, a top layer on the basis of synthetic material, and an underlying substrate, whether or not composed of several layers or parts, characterized in that the floor panel, in the surface over which the decor extends, is provided with embossed portions continuing up into the aforementioned substrate, whereby these embossed portions at least are applied for imitating the aforementioned removed wood portions.

By applying embossed portions continuing up into the aforementioned substrate, the advantage is created that the surface, at the location of the embossed portions, is situated rather deep, as a consequence of which a better imitation of scraped wood is possible.

In such scraped wood, the scraped-off portions mostly extend over a relatively large surface. When the scraped-off portions then are imitated in a laminate floor by providing embossments in the laminate layer that, in depth, extend exclusively in this laminate layer, the disadvantage is created that the depth, in relation to the surface, is very small, as a result of which the intended effect is almost not noticeable. By applying, however, in accordance with the present invention, deeper embossed portions, this disadvantage is minimized.

Moreover, the inventor, contrary to all expectations, has found that the usual substrates, and in particular MDF and HDF, allow for that also dimensionally stable embossed portions can be realized, even if the embossment extends into the substrate.

According to a preferred form of embodiment of the first aspect, the floor panel further is characterized in that the embossed portions at least comprise portions that are realized as sunk portions imitating wood portions removed from the surface.

According to another preferred form of embodiment of the first aspect, the floor panel is characterized in that it has, at least along one edge, and preferably at least at two opposite edges or at four edges, a sunk edge area having at least one sloping edge portion.

According to another preferred form of embodiment of the first aspect, the floor panel is characterized in that the aforementioned sunk edge area is performed as an embossed portion, which, as aforementioned, continues up into said substrate.

According to another preferred form of embodiment of the first aspect, the floor panel is characterized in that the decor represents a wood pattern and that the wood pattern comprises at least one edge area in which a visual edge effect is integrated.

Finally, it is preferred that in a floor panel according to the first aspect of the invention, the substrate, at the location of said embossed portions, at least at the locations where these portions are embossed the deepest, shows an embossment over a distance of minimum 0.4 mm, and even better minimum 0.5 mm.

According to a second aspect, the present invention relates to a floor panel, which, at least at two opposite edges, is provided with coupling parts, whereby this floor panel comprises a decor, a top layer on the basis of synthetic material, and an underlying substrate, whether or not composed of several layers or parts, characterized in that the floor panel, in the surface over which the decor extends, is provided with one or more embossed portions continuing up into the aforementioned substrate, whereby the depth of one or more of the embossed portions, in other words, the height difference between the un-embossed upper side of the floor panel and the deepest point of these embossed portions, is larger than the nominal thickness of the top layer situated on top of the substrate.

By applying embossments of the aforementioned depth, it is obtained that these embossments are clearly noticeable.

Also, in the embossed portions themselves height differences may be incorporated, which, with embossments that are limited to the thickness of the top layer, is hardly possible or not at all possible.

According to a preferred form of embodiment of the second aspect of the invention, the floor panel further is characterized in that it is an imitation of wood, from which, by means of a tool, pieces have been removed from the surface, more particularly an imitation of so-called scraped wood. More particularly, the floor panel comprises embossed portions that are realized as sunk portions imitating wood portions that have been removed from the surface.

According to another form of embodiment of the second aspect, the floor panel, along at least one edge, and preferably at least at two opposed edges or at four edges, has a sunk edge area comprising at least a sloping edge portion. This sunk edge portion preferably is performed as an embossed portion continuing, as aforementioned, up into said substrate, whereby the depth of this embossed portion, in other words, the height difference of the un-embossed upper side of the floor panel and the deepest point of this embossed portion, is larger than the nominal thickness of the top layer situated on top of the substrate.

Also in the floor panels of the second aspect, use can be made of a decor representing a wood pattern, and this wood pattern may show one or more edge areas in which a visual edge effect is integrated. With other patterns, too, a visual edge pattern can be created in the decor.

According to a third aspect of the invention, it relates to a floor panel, which, at least at two opposite edges, is provided with coupling parts, whereby this floor panel comprises a decor, a top layer, more particularly laminate layer, on the basis of synthetic material, and an underlying substrate, whether or not composed of several layers or parts, characterized in that the floor panel, in the surface over which the decor extends, is provided with one or more embossed portions, whereby the decor itself, at the location of these embossed portions, is at least embossed over 0.4 millimeters and even better over at least 0.5 millimeters.

By using embossed portions whereby the decor itself is embossed over at least 0.4 millimeters, at least 0.5 millimeters, respectively, the advantage is created that the actual visible surface also is embossed over this distance, as a result of which a properly visible embossment is created.

This third aspect, too, is particularly useful for imitating wood, from which pieces have been removed from the surface by means of a tool, more particularly for imitating so-called scraped wood. Herein, the aforementioned embossed portions preferably at least are applied for imitating local sunk portions or recesses in the surface.

In a particular form of embodiment of a floor panel according to the third aspect of the invention, this panel will show, along at least one edge, and preferably at least at two opposite edges or at four edges, a sunk edge area having at least one sloping edge portion. Preferably, this sunk edge area is also realized by means of an embossment, whereby the decor is embossed over at least 0.4 millimeters and better at least 0.5 millimeters, with which is meant that at least in the deepest-situated point of such sunk edge area, such embossment is performed.

Further, a floor panel according to the third aspect of the invention can also be provided with a decor representing a wood pattern or other pattern, whereby this pattern shows an edge area into which a visual edge effect is integrated.

According to a fourth aspect, the present invention relates to a floor panel, which, at least at two opposite edges, is provided with coupling parts, whereby this floor panel comprises a decor, a top layer on the basis of synthetic material, and an underlying substrate, whether or not composed of several layers or parts, characterized in that the floor panel, at one or more edges, shows an edge area sloping towards the respective edge, said edge area extending over the surface of said decor and being formed by means of an embossed portion. The application of a sloping edge portion extending over the surface of the decor and being realized by means of an embossed portion, offers various advantages. By means of such sloping edge portion, it is obtained, amongst others, that the floor panels in coupled condition do not adjoin directly against each other with their flat upper side, whereby, when two adjacent floor panels are situated somewhat at an angle in respect to each other, as a result of an uneven subfloor, this will be less apparent. In that the sloping edge area extends over the surface of the decor itself, this can simply be realized during pressing of the boards of which the floor panels are formed. The use of a sloping edge area also offers the advantage that a possible relief, which is provided in the upper side of the floor panel, can run out towards the edges more or less uniformly.

It is noted that the fourth aspect of the invention can be applied in various kinds of floor panels. However, it is particularly useful when imitating wood, from which, by means of a tool, pieces have been removed from the surface, more particularly the imitation of so-called scraped wood.

In a particular form of embodiment of a floor panel that is realized according to the fourth aspect of the invention, this shall be provided with a decor representing a wood pattern or other pattern and, in this pattern itself, at least one edge area shall be represented into which a visual edge effect is integrated.

According to a fifth aspect, the invention provides a floor panel, which, at least at two opposite edges, is provided with coupling parts, whereby this floor panel comprises a decor, a top layer or laminate layer on the basis of synthetic material and an underlying substrate, whether or not composed of several layers or parts, characterized in that the floor panel, at one or more edges, has an edge portion consisting at least of a sloping edge area extending over the surface of said decor, as well as of a portion, hereafter named second portion, situated between the edge of the floor panel and the sloping edge portion. The use of said second portion offers the advantage that with tolerance differences occurring when forming the coupling parts that are present at the edge of the floor panel, possible differences in height at the upper edge are excluded or are minimized, such that, when coupling two floor panels, it can always be guaranteed that these adjoin each other at approximately the same height.

For the same reason, this second portion, in the most preferred form of embodiment, then will be realized parallel or substantially parallel to the main plane of the floor panel, in other words, with normal use it will be horizontal or substantially horizontal.

It is clear that the fifth aspect of the invention again can be applied with different kinds of floor panels. A particularly useful application, however, is with floor panels imitating wood from which, by means of a tool pieces have been removed from the surface, more particularly floor panels imitating so-called scraped wood. To with, these floor panels obtain their typical appearance by using a sloping edge portion. By applying the aforementioned second portion, between this sloping edge area and the upper edge of the floor panel, thus the aforementioned disadvantages of possible height differences are excluded.

However, it is noted that in a well-controlled milling process, said tolerance differences are limited and that therefore, it is clear that the aforementioned second portion does not necessarily have to be present in order to obtain a good adjoining of two floor panels almost without height differences.

In a particular form of embodiment of a floor panel according to this fifth aspect, this floor panel is provided with a decor representing a wood pattern or other pattern, whereby also at least one visual edge effect is integrated into this pattern.

According to a sixth aspect, the invention relates to a floor panel, which, at least at two opposite edges, is provided with coupling parts, whereby this floor panel comprises a decor, a top layer on the basis of synthetic material, and an underlying substrate, whether or not composed of several layers or parts, and whereby the decor represents a wood pattern, characterized in that the decor, in the wood pattern, comprises an edge area in which a visual edge effect is integrated, and that the visual edge effect is combined with an actually sloping edge portion at the respective edge. By making a combination of an actually sloping portion and a visual edge effect, the possibility is obtained to imitate a good protection at a floor panel. By representing a visual edge effect only, for example, by means of a shadow printed into the decor, a very unnatural effect is created. By using exclusively a sloping edge portion, indeed a real effect is created, however, this real effect mostly is connected to restrictions in respect to depth. By now making, according to the sixth aspect, a combination of both, it is possible, as aforementioned, to effect a good imitation.

It is clear that this sixth aspect can be applied in different forms of embodiment of floor panels. Again, a particular application, however, is a floor panel forming an imitation of wood, from which, by means of a tool, pieces have been removed from the surface, more particularly an imitation of so-called scraped wood.

It is noted that the sloping portion preferably is realized by means of an embossment, although other techniques are not excluded for forming such sloping portion.

According to a seventh aspect, the invention relates to a floor panel, which, at least at two opposite edges, is provided with coupling parts, whereby this floor panel comprises a decor, a top layer on the basis of synthetic material, and an underlying substrate, whether or not composed of several layers or parts, characterized in that the floor panel, in the surface over which the decor extends, is provided with at least two kinds of portions realized by means of embossing, on the one hand, one or more embossed portions substantially continuing up into said substrate, and, on the other hand, embossments substantially extending locally in the top layer. By realizing the aforementioned two kinds of portions, a technical means is offered by which a broad range of new possibilities for forming surfaces of floor panels is created. Hereby, also the advantage is created that different relief forms can be integrated into one and the same surface, in a very pronounced manner, whereby a first relief is formed by means of the aforementioned embossed portions continuing up into the substrate, and a second relief is formed by means of the aforementioned embossments extending substantially locally in the top layer.

It is noted that the aforementioned embossments also can be realized at least partially in the top layer at the location of the embossed portions, in other words, that two forms of relief can be realized that overlap each other.

In order to make a clearly noticeable difference between the aforementioned embossed portions and the aforementioned embossments, it is preferred that the substrate, at the location of the embossed portions, is embossed at least 0.4 millimeters and even better at least 0.5 millimeters.

It is noted that the characteristics of the aforementioned aspects, inasmuch as they are not contradictory to each other, can be combined at random in the same floor panel.

Moreover, one or more preferred characteristics can be integrated in the floor panels of the aforementioned aspects of the invention. These characteristics will be described more detailed hereafter and can be applied in any of the aforementioned floor panels.

The aforementioned substrate preferably consists of a product on the basis of wood and even better of wood fiberboard, in particular MDF or HDF. The inventor has found that this kind of material, amongst others, is very suited for realizing embossed portions, wherein the embossment is performed more deeply than only in the laminate layer located on the substrate.

Preferably, the entire core of the board consists of MDF/HDF, however, it is not excluded to make use of a composed core, whereby a layer of MDF/HDF is present directly beneath the laminate layer, whereas below this, still other layers are applied, whether or not of other materials. Also, it is not excluded to modify the MDF/HDF board, such as, for example, by removing possible hard surface layers. It is noted that, when removing such surface layer, this is preferably performed at the lower side as well as the upper side of the board in order to avoid warping of the board. By said hard surface layers, zones in the MDF/HDF itself are meant, which are situated in the proximity of the board's surface and which have a higher density than the board's core material.

According to an important preferred aspect, the floor panel is characterized in that substantially the entire core of the floor panel consists of a board of MDF/HDF fulfilling the function of the aforementioned substrate; that the embossed portions extending up into this core are performed such that the underside of the aforementioned board remains un-deformed; and that the embossed portions are only local, such that the board globally, thus at the locations where there are no embossments, is compacted little or not at all, more particularly the possible compacting, as measured outside the embossed portions, is less than 1%.

Preferably, the aforementioned decor consists of a printed carrier, more particularly printed paper.

In a practical form of embodiment, so-called DPL (Direct Pressure Laminate) is applied for the laminate layer, preferably of the type that is formed of two layers, namely a resin-impregnated and printed carrier and a so-called overlay. In connection therewith is noted that the inventor, contrary to all expectations, has found that even thin laminate layers, such as DPL, can be embossed up to depths that are larger than the thickness of the laminate layer itself.

Preferably, the thickness of the top layer or laminate layer is smaller than 0.2 millimeters.

More particularly, a laminate layer shall be used that, as such, can be composed of one or more material layers and which is realized on the basis of a thermo-setting resin, more particularly a melamine resin.

It is noted that instead of using a decor printed upon a carrier, such as paper, also other techniques are possible to integrate such printed decor into a floor panel according to the invention. So, for example, it is not excluded to print the decor onto the substrate, either directly, or by means of the intermediary of a primer, sealing layer or the like. On top thereof, then a transparent top layer can be provided, after which the floor panel is provided with embossed portions and/or embossments and/or sloping portions.

Preferably, the aforementioned embossed portions are the result of a press treatment by means of a press plate and do they have continuous transitions at their edges, which transitions are free of step-wise transitions traditionally occurring when a press plate is applied that is realized by means of several etching operations. By excluding, or minimizing, this specific type of step-wise transitions and using only continuous transitions, except when step-shaped transitions are explicitly desired, the advantage is created that uniformly sloping portions, for example, edge portions, can be realized, which, on one hand, are more realistic, but, on the other hand, also are less subject to wear, contrary to step-wise performed surfaces.

Preferably, the embossed portions are the result of a press treatment by means of a press plate, of which the projecting parts, which have to form the aforementioned embossed portions, are the result of treating the press plate with a machining tool, more particularly a milling cutter. This has the advantage that the typical disadvantages of usual etching processes can be excluded.

According to a particular form of embodiment, the floor panel, apart from the aforementioned embossed portions, also comprises embossments being substantially smaller than the aforementioned embossed portions, whereby these embossments preferably indeed are the result of projections realized in the aforementioned press plate as a result of an etching technique.

The invention is intended in particular for "embossed portions" of a larger extent and thus not, for example, for embossments for realizing imitations of wood pores. Preferably, thus embossed portions are concerned extending at least over a surface that is larger than 0.5×0.5 cm.

Preferably, the depth of one or more of the aforementioned embossed portions and/or of the sunk edge areas, in other words, the height difference between the un-embossed upper side of the floor panel and the deepest point of these embossed portions, the height difference between the upper side of the floor panel and the deepest point of the sunk edge area, respectively, is less than 1.5 millimeters. Hereby, the advantage is created that the risk that the top layer, and in particular the decor, are damaged when performing the embossment, is almost non-existing.

On the other hand, it is indeed preferred that the aforementioned depth is at least 0.4 millimeters and even better at least 0.5 millimeters. Of course, this does not have to be for all embossed portions.

In the case that the floor panel has embossments imitating so-called scraped wood, among these embossments preferably embossments are present that extend in the form of longitudinally-directed paths. Also, embossments may be present that extend in transverse direction.

In a particularly preferred form of embodiment of a floor panel imitating scraped wood, the removed wood portions to be imitated will be imitated in the depiction of the decor as well as by means of really applied embossed portions, and these embossed portions shall be provided in accordance with the decor at the upper side of the floor panel.

In the case that the floor panel comprises embossed portions forming sunk portions that imitate so-called scraped wood, as well as comprises sloping edge portions, it is preferred that the embossed portions made as sunk portions are present in the upper surface of the floor panel as well as in the edge areas thereof.

In the case that the floor panel is provided with said sloping edge portion, this sloping edge area, according to a cross-section transverse to the respective edge, extends over a distance of preferably at least 3 millimeters and even better at least 5 millimeters, however, preferably less than 15 millimeters.

Further, such sloping edge portion preferably will show an inclination that is smaller than 10 degrees and even better is smaller than 5 degrees.

In the case that the aforementioned floor panel is provided with a sunk edge area with a sloping edge portion, possibly a second portion, which is less sloping and preferably is substantially flat, is situated between the sloping edge portion and the upper edge of the floor panel.

Such second portion extending between the upper edge and the sloping portion, preferably is parallel or substantially parallel to the main plane of the floor panel. This second portion is optional.

According to a particular form of embodiment, the sunk edge area, and more particularly the sloping portion, on the one hand, and the pattern of the decor located underneath, on the other hand, are realized corresponding to each other. Hereby is meant that, for example, when representing scraped wood, whereby in real wood, the pattern changes in that there is an inclined cutoff at the edge, this is represented in the printed decor, too.

In the case that sloping edge portions are used, those preferably are applied at least at two opposite edges. In the case of an oblong floor panel, this preferably are the longitudinal edges. However, it is clear that such sloping portion and/or sunk edge area also can be applied at the four edges of a floor panel.

In the case that, as aforementioned, a visual edge effect is applied, this can be realized in various ways. Two important possibilities thereof are described below.

According to a first possibility, the visual edge effect consists at least in that in the edge area, crosscut wood is depicted in the decor, that imitates the effect as if a bevel were realized through the wood. In that the crosscut wood is represented in the decor itself, only a suitable decor must be designed and is it not necessary to provide separate coverings at the respective locations. It is clear that, when imitating planks, such visual edge effect shall be represented at the short sides of these planks.

It is noted that also solely by imitating crosscut wood, an optical depth-effect is created.

According to a second possibility, the aforementioned visual edge effect at least consists in that, in the edge area, a shadow effect is depicted in the decor. Hereby, the shadow effect extends over the decor, for example, the wood pattern, itself, and this is performed such that this shadow creates the effect of a sloping edge. In practice, the shadow applied therewith thus shall be relatively wide and preferably shall have at least a width of 0.5 cm.

In the case of rectangular, either square, or longitudinal floor panels, then preferably one edge of at least one pair of opposite edges shall be provided with such shadow effect, whereas the opposite edge does not show a shadow or shows a less pronounced shadow.

Also, such shadow effect can be applied at both pairs of edges instead at one pair of edges, whereby both pairs of opposite edges then have one edge with such shadow, whereas the other edge of each pair does not show a shadow or shows a less pronounced shadow.

In the most preferred form of embodiment, the visual edge effect is combined with a really sloping portion at the respective edge, preferably a sloping embossed portion that is realized as mentioned before.

According to a particular form of embodiment, a shadow effect is represented not only in one or more of the edge areas, but, for example, also in the area located centrally therebetween. In the case of an imitation of scraped wood, a shadow can be depicted at the edges of the embossed portions.

It is noted that the shadow for creating the aforementioned shadow effect possibly can be represented in a gradual manner.

In the case that the decor represents a wood pattern, embossments imitating wood pores can be provided in the upper side. In that case, it is preferred that the embossments imitating the wood pores correspond to the wood pattern, in other words, that to this aim a so-called "registered embossed" technique, known as such, is applied.

According to the present invention, the embossments imitating wood pores preferably are also provided in the aforementioned embossed portions, and more particularly in the sloping portions and/or portions intended for imitating "removed wood portions".

The depth of the embossments imitating the wood pores preferably is smaller than the thickness of the aforementioned layer of synthetic material.

In the case that the decor shows a wood pattern, the floor panel may be realized such that one and the same wood pattern extends over the entire panel, such that one floor panel forms a representation of one one-piece wooden plank. This is particularly advantageous in the case of floor panels intended for imitating so-called scraped wood.

According to another particular form of embodiment, in the case one works with a printed decor consisting of impregnated paper, use is made of especially stretchable paper, as a consequence of which this latter will adapt better to the deformations occurring when realizing the embossed portions.

Further, the invention, according to a particular aspect, also relates to a particular method for realizing floor panels, which, amongst others, is very suited for realizing the above-described floor panels. According to this aspect, the invention relates to a method for manufacturing a floor panel, whereby this floor panel is of the type that comprises at least a substrate, as well as a decor, and a top layer on the basis of synthetic material, characterized in that this method comprises at least the following steps:

making a press plate, whereby this press plate is provided with a relief at its surface, hereafter called first relief, which at least is realized by means of a machining operation at the surface, by means of a mechanical tool;

forming said floor panel, whereby said press plate is applied for forming, by means of the aforementioned first relief, embossed portions in the decorative side of the floor panel, and more particularly in the decorative side of a board of which subsequently such floor panels are formed.

By using a press plate, which, as aforementioned, is realized by means of a machining treatment with a mechanical tool, it is possible to realize relatively large relief differences in an efficient manner, whereas moreover continuous transitions are possible, which, when realizing large relief differences, is not possible exclusively by etching, as then step-shaped transitions are created.

In a particular form of embodiment, the press plate is provided with a separately realized second relief, preferably after the first relief has been realized. This offers the advantage that two relief forms can be superposed on top of each other. Hereby, the second relief preferably is finer than the first relief.

Preferably, the second relief is obtained by a treatment other than a machining treatment with a mechanical tool.

In the case that the above-described method is applied for manufacturing the above-described floor panels, it is clear that the aforementioned "embossed portions" substantially are realized by means of the aforementioned first relief of the press plate, whereas, for example, the "embossments" for realizing the pore structure or the like are realized by means of the second relief.

In the most preferred form of embodiment, the first relief in the press plate is realized by means of a milling process, more particularly a digitally controlled milling process.

Preferably, the second relief, in case that a second relief is applied, is realized by means of etching. According to the present invention, to this aim possibly a number of special etching techniques can be applied, which are particularly advantageous in order to obtain that a good etching can be realized, notwithstanding the fact that the surface to be etched already shows unevennesses, which can be rather large, as a result of the first relief. Also, hereby etching techniques are concerned whereby in one operation larger parts of a press plate, and preferably the entire press plate, can be provided with a protective substance, such in an accurate manner.

According to a first particular possibility, an etching technique is applied, which at least consists of applying a substance that can be hardened by means of radiation, more particularly by means of light, such as UV light, preferably in the form of a gel, over the surface of the press plate to be etched, whereby this substance continuously extends over the embossed and not embossed portions; applying a film over this substance, which film is provided with a print or the like, having portions that are impervious to said radiation, whereby this film is forced to follow unevennesses in the substance, preferably by drawing the film towards the substance by means of vacuum drawing; having radiation effect in such a manner that those portions of said substance that are accessible to the radiation, are hardened; removing said film; removing the un-hardened portions of said substance; and etching the press plate, whereby then substantially material is etched off the press plate at those locations where no material of said substance is present. Said film can be realized in a digital manner, preferably by means of a print by means of a digitally controlled printer.

According to a second particular possibility, systematically, directly or indirectly a protective pattern is built up by means of a device or part of a device moving in respect to the press plate, said device being digitally controlled.

According to a first form of embodiment of this second possibility, an etching technique is applied, which at least consists of applying a substance that can be hardened by means of radiation, more particularly by means of light, such as UV light, preferably in the form of a gel, over the surface of the press plate to be etched; depositing a protective product, systematically and in form of a pattern, on this substance, such that certain zones become impervious to said radiation; having radiation effect in such a manner that those portions of said substance that are accessible to said radiation, are hardened; removing the un-hardened portions of said substance; and etching the press plate, whereby then substantially material is etched off the press plate at those locations where no material of said substance is present. Preferably, the aforementioned pattern is provided on the substance by means of a digitally controlled printer, the printing unit of which is moved over the substance. An advantage thereof is that the pattern can be applied very precisely.

According to a second form of embodiment of the second possibility, an etching technique is applied consisting at least of applying a protective substance on the press plate by means of a digitally controlled application device according to a pattern on the press plate itself, such that certain zones of the press plate are covered; having an etching agent effect on the press plate in such a manner that substantially material is etched off the press plate at those locations where no material of said substance is present; and cleaning the press plate. The application device can be a printer, for example, an inkjet printer, which then, instead of the usual ink, sprays a protective substance for etching agents onto the press plate, according to the desired pattern. It is evident that this substance must be acid-proof. It can be a substance that hardens by itself, or which must be subjected to radiation before hardening, such as radiation by heat, UV light or the like.

According to a third form of embodiment of the second possibility, an etching technique is applied, which consists at least of applying a substance that can be hardened by means of radiation, more particularly by means of light, such as UV light, preferably in the form of a gel, over the surface of the press plate to be etched; selectively having radiation effect, by means of a controlled, preferably digitally controlled, radiation source, such that certain portions of said substance are hardened; removing the un-hardened portions of said substance; and etching the press plate, whereby then substantially material is etched off the press plate at those locations where no material of said substance is present. In this manner, too, a precise protective pattern can be realized, notwithstanding the fact that the press plate already shows an uneven surface due to the first relief.

In the forms of embodiment of the aforementioned second possibility, it is preferred that use is made of auxiliary means moving over the surface of the press plate and adapting directly or indirectly in function of the position of the surface in respect to these auxiliary means. According to a possibility, the adaptation can take place by means of a focus adjustment. According to another possibility, this takes place by means of a distance adjustment in respect to the press plate.

The above does mean, for example, that in said first form of embodiment, the auxiliary means consist of a printer, whereby the printer, for example, has a printing head, of which the printing focus and/or the distance to the press plate is alterable. In said second form of embodiment, the application device for applying a protective substance can be adjustable. In the third form of embodiment, the radiation source for radiating a hardenable substance provided on a press plate can be adjustable.

According to another possibility than etching, the second relief is realized by means of a controlled, preferably digitally controlled, material-removing process, for example, by means of spark erosion, and more particularly by means of so-called spark milling. Also, a usual milling process with, for example, finer milling cutters than those by which the first relief can be manufactured, is not excluded.

For forming the first relief, also another technique than a machining operation by means of a mechanical tool can be applied, however, other than etching. So, for example, may the press plate as such be subjected to a press treatment in order to give the surface of the press plate a desired relief.

For the press plate generally a so-called platen is applied, which has been left substantially flat at its rear side.

According to a particular method of the invention, the floor panels, and more particularly the boards of which the floor panels are formed, are realized by means of at least two press cycles instead of only one press cycle. To this aim, the invention also relates to a method for manufacturing a floor panel, whereby this floor panel is of the type comprising at least a substrate, as well as a decor, and a top layer on the basis of synthetic material, characterized in that the floor panels, or at least the plates of which the floor panels are manufactured, are provided with a final relief in at least two press treatments, namely, a first press treatment, whereby a relief is performed in the surface of the floor panels or boards that substantially consists of embossments extending substantially exclusively in the top layer of synthetic material, and a second press treatment, whereby subsequently embossed portions are performed in the floor panels or boards, which continue up into the aforementioned substrate.

In the case that this method is applied for manufacturing floor panels of the DPL type, preferably, during the first press treatment, the top layer is pressed onto the substrate.

Preferably, the floor panels, more particularly the boards of which the floor panels are manufactured, are supplied to the second press treatment in warm condition, either because they are still warm from the first press treatment, or because they are warmed up again. It is also possible to work with a press, whether or not heated, in the second press cycle.

It is clear that this method can be applied for realizing the above-described floor panels, as well as other floor panels. The invention also relates to methods for manufacturing a press plate for pressing laminate boards or the like, whereby the above-described techniques are applied, irrespective whether or not this press plate is applied for manufacturing floor panels. Further, it also relates to the press plates thus obtained.

Other characteristics follow from the detailed description of the claims.

Figure 2:
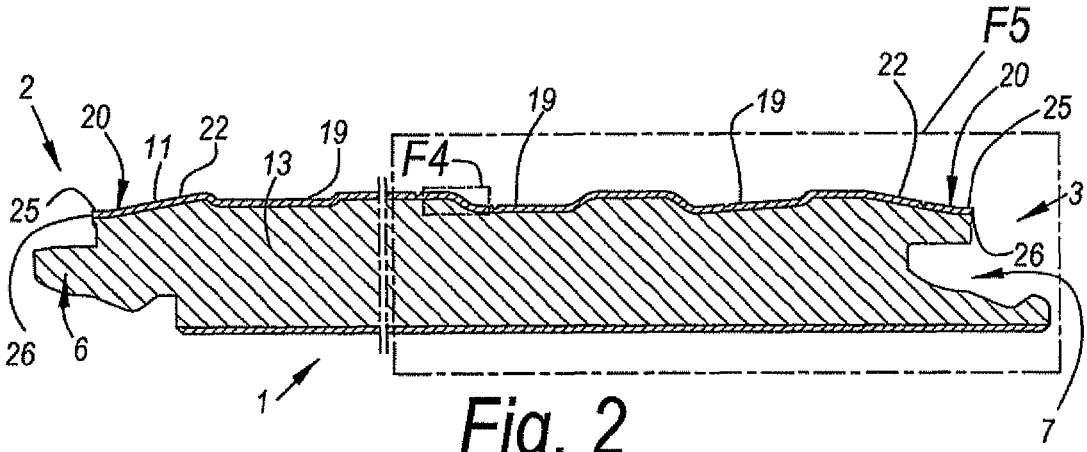
Figure 3:
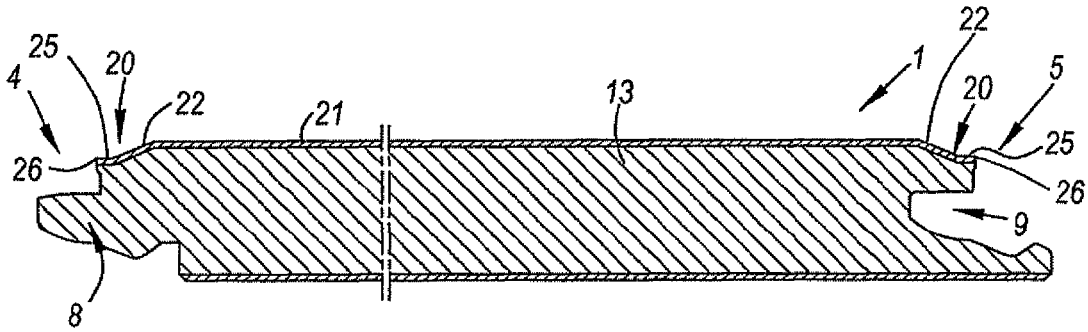
Figure 4:
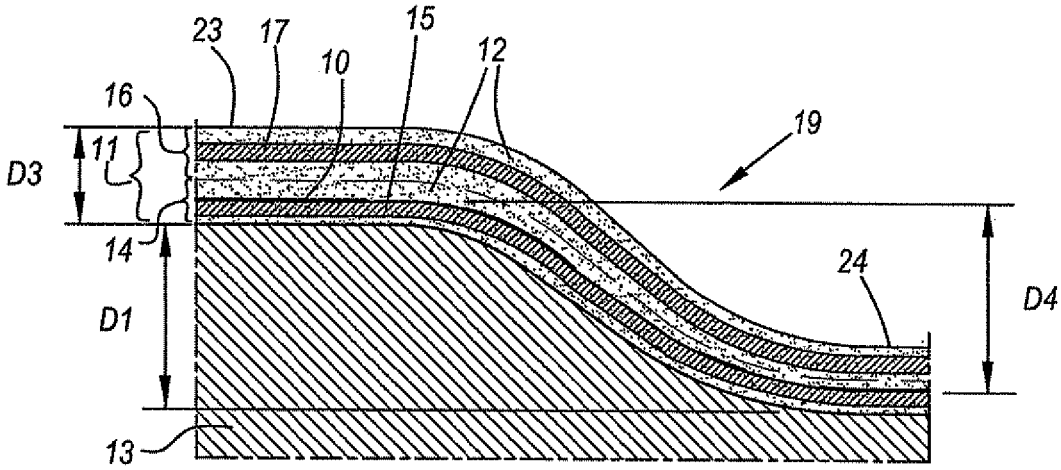
Figure 6:
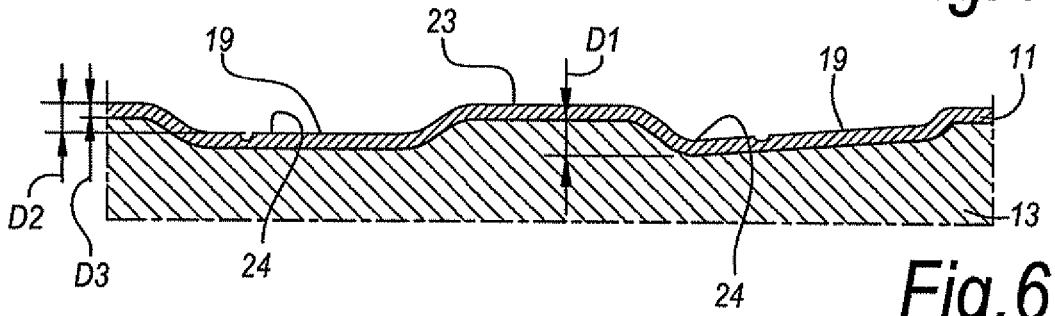
Figure 7:
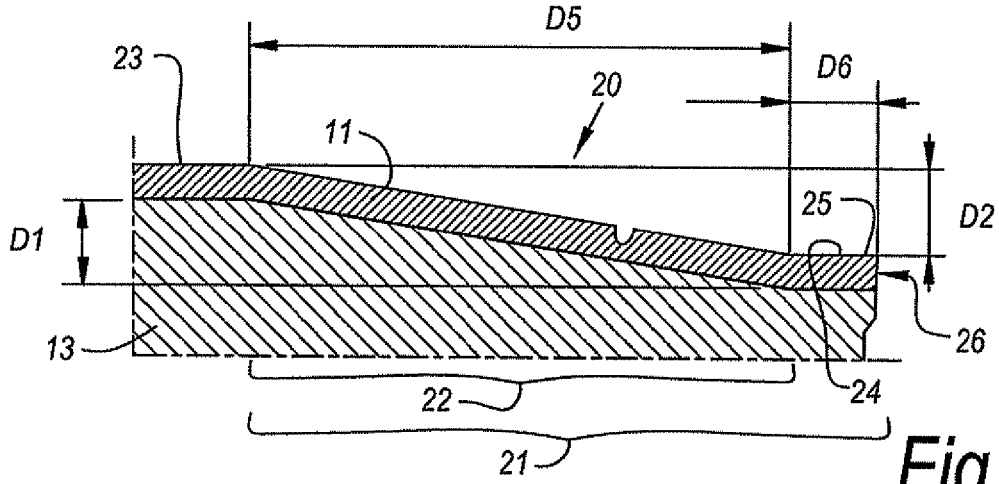
Figure 8:
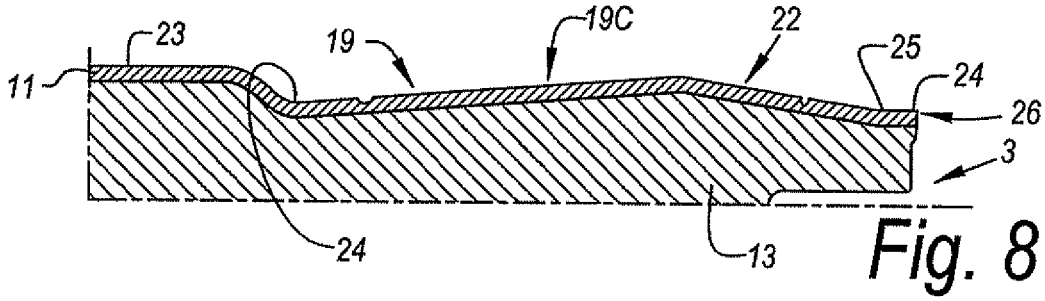
Figure 5:
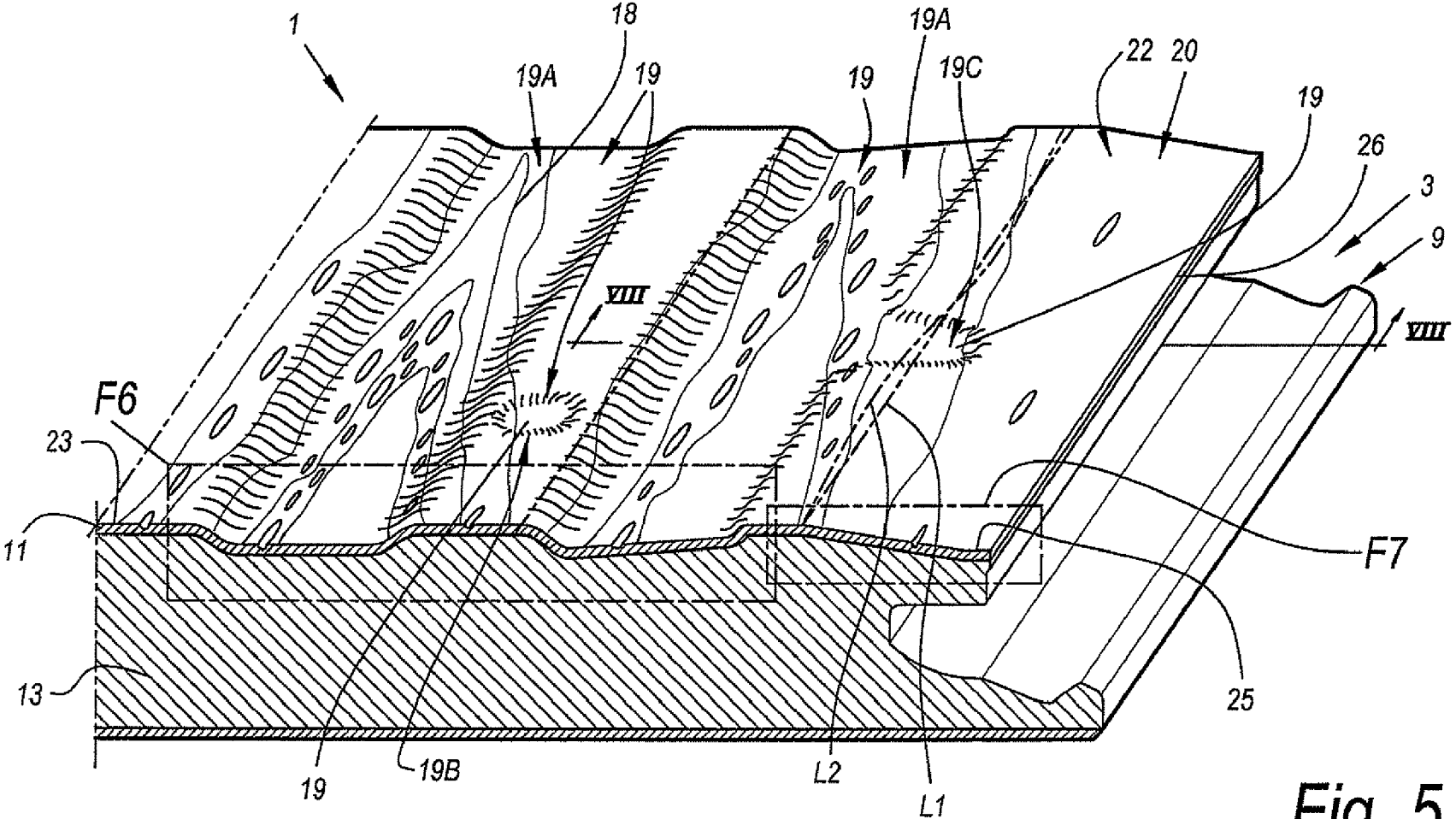
Figure 9:
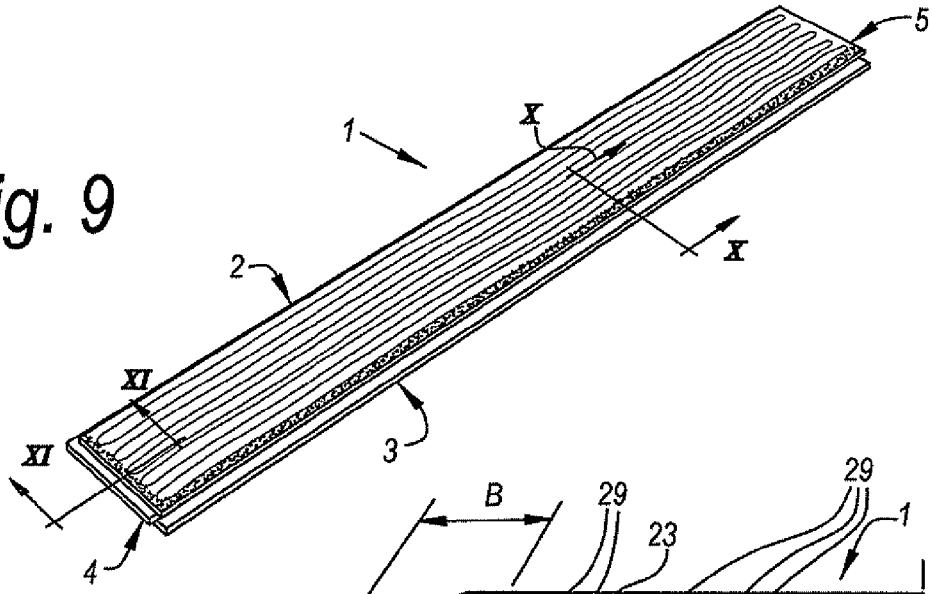
Figure 11:
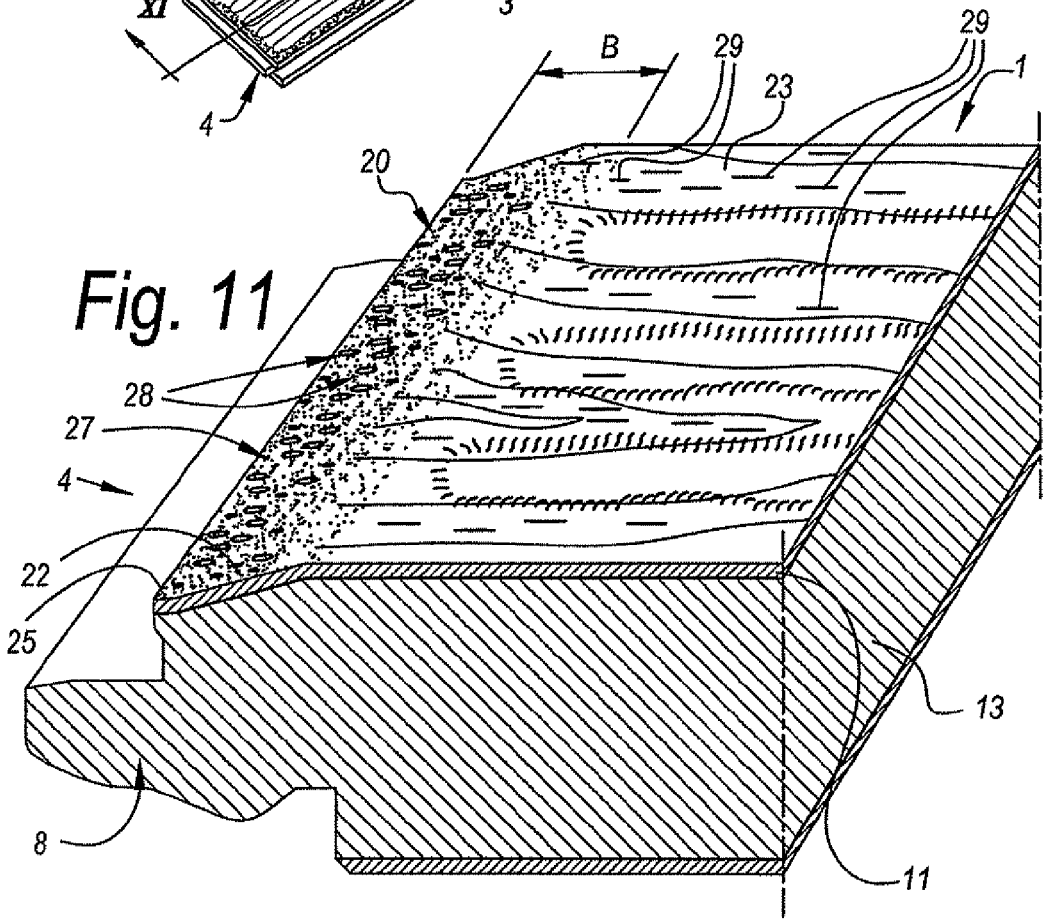
Figure 12:
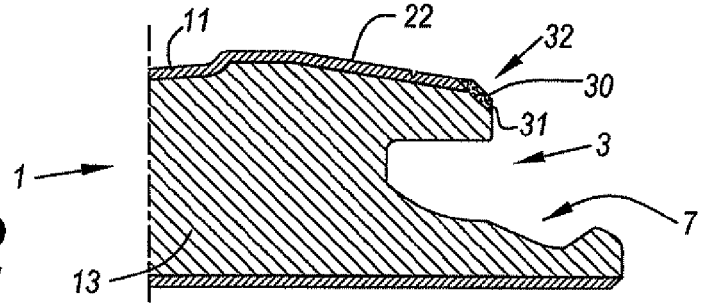
Figure 10:
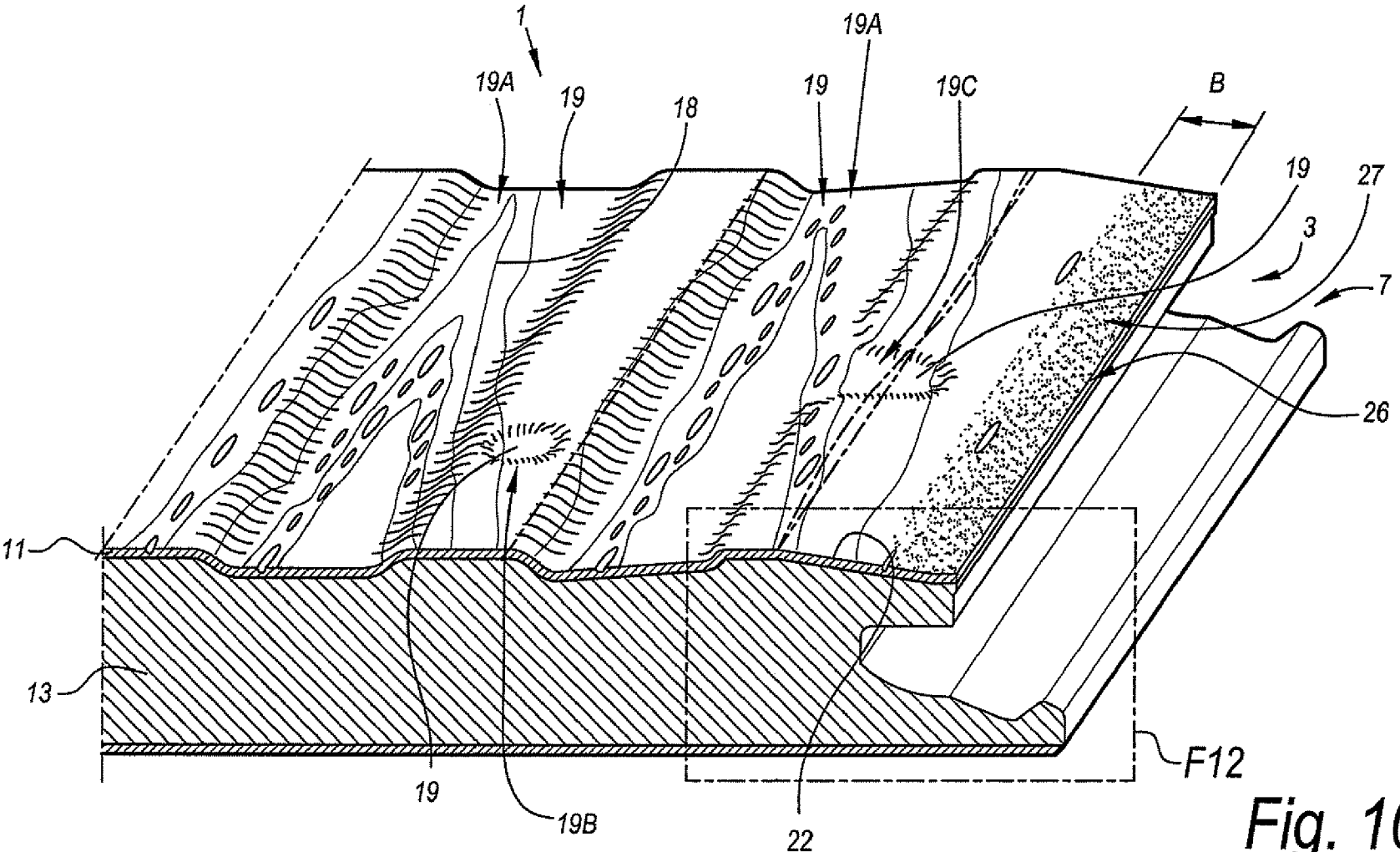
Figure 13:
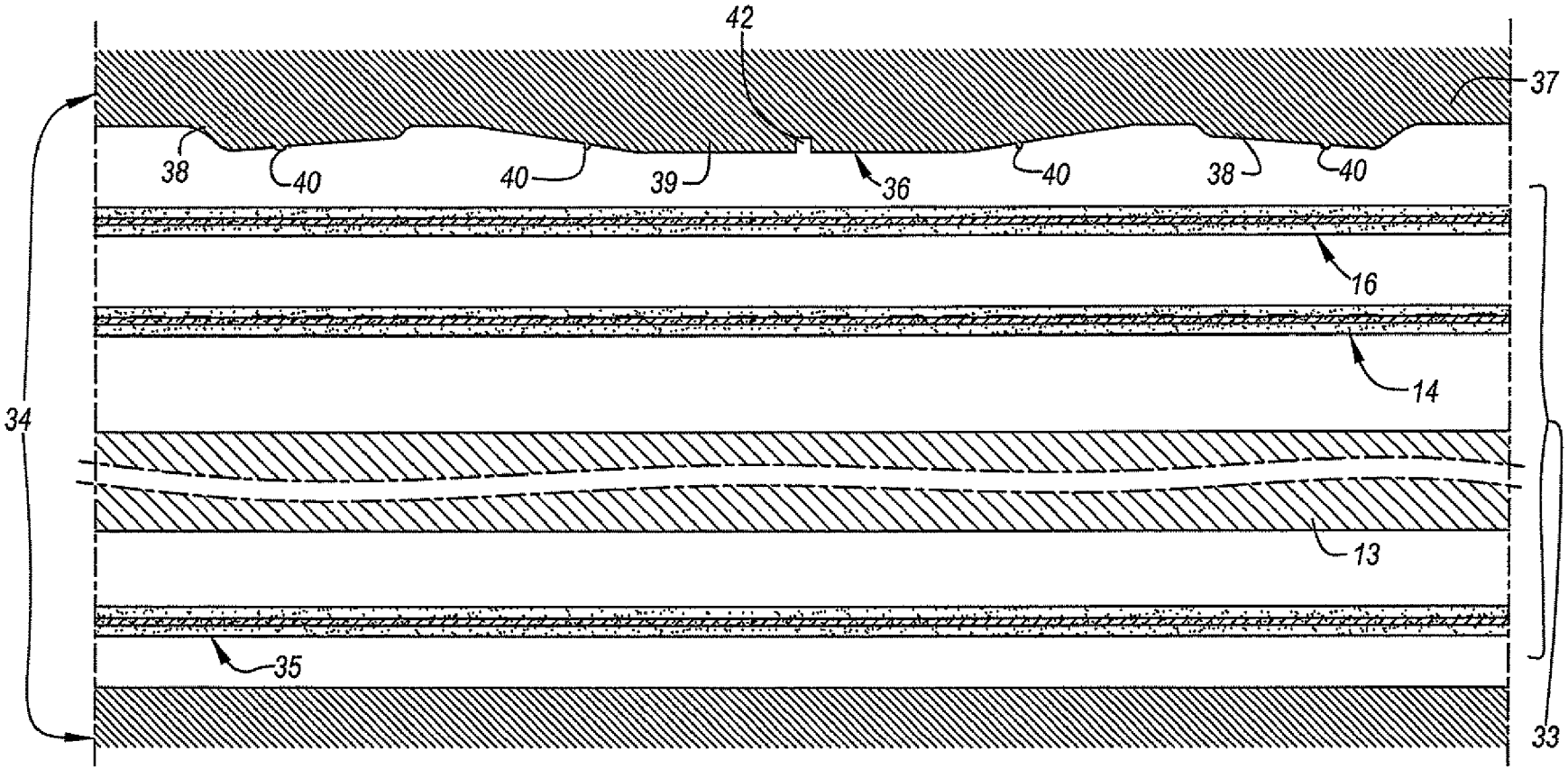
Figure 14:
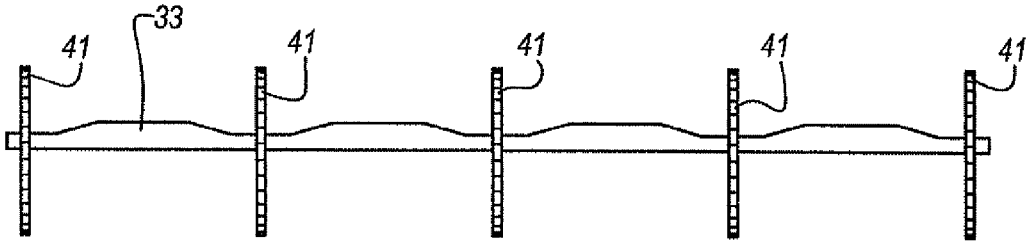
Figure 15:
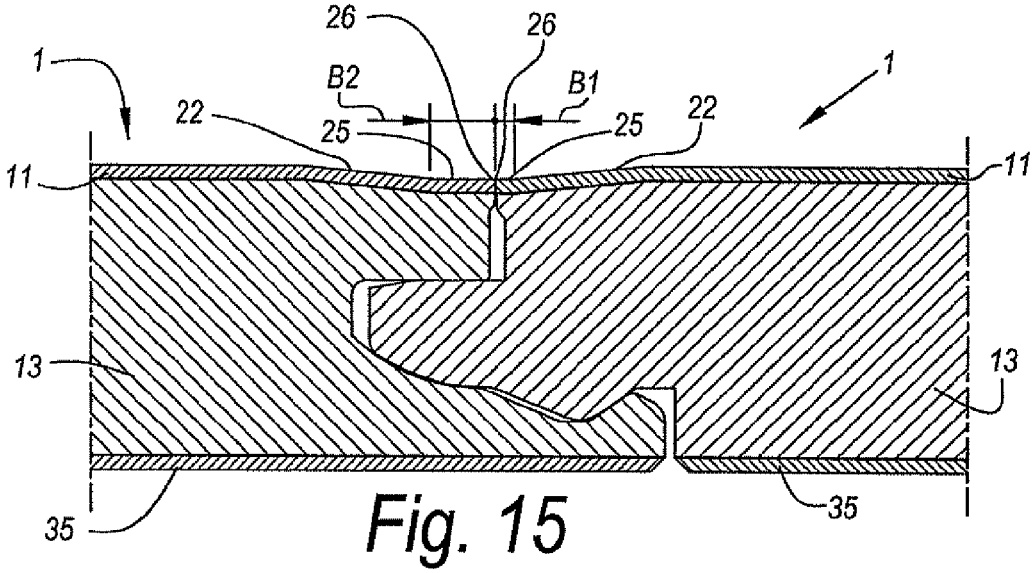
Figure 16:
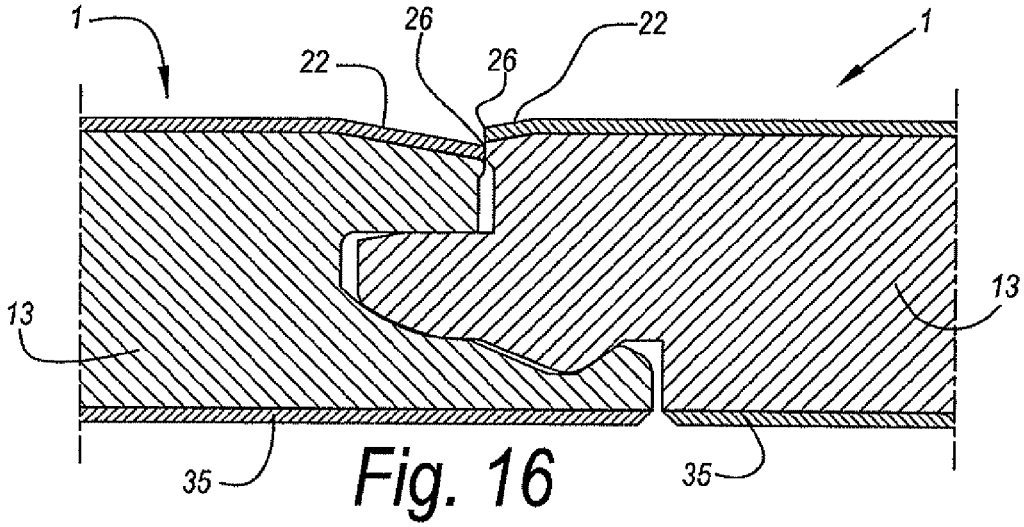
Figure 25:
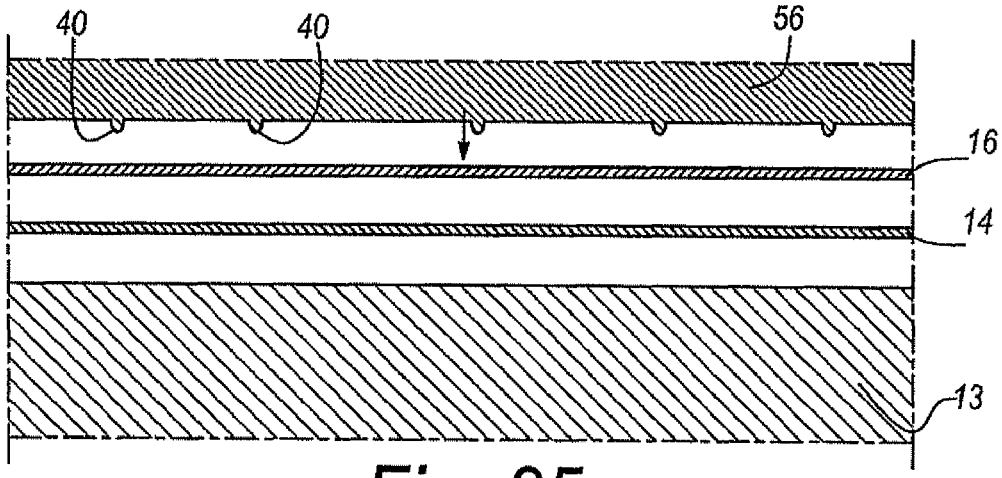
Figure 26:
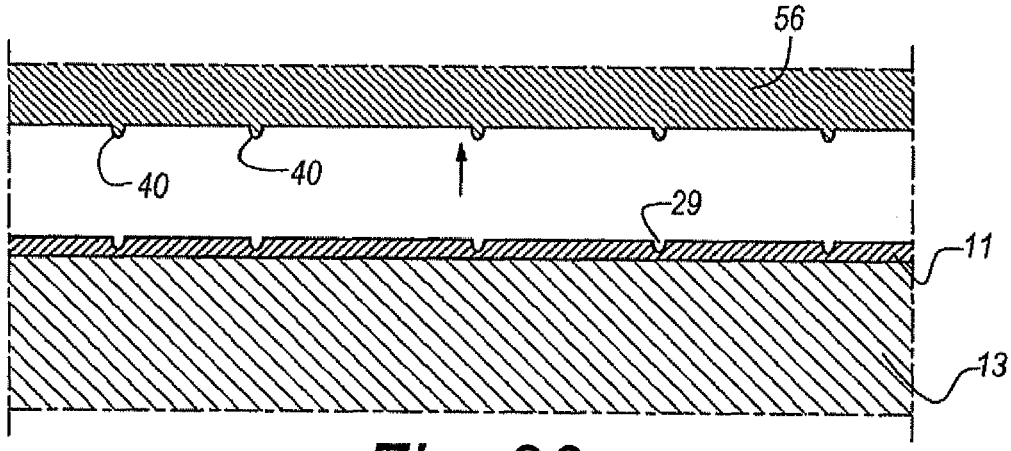
Figure 27:
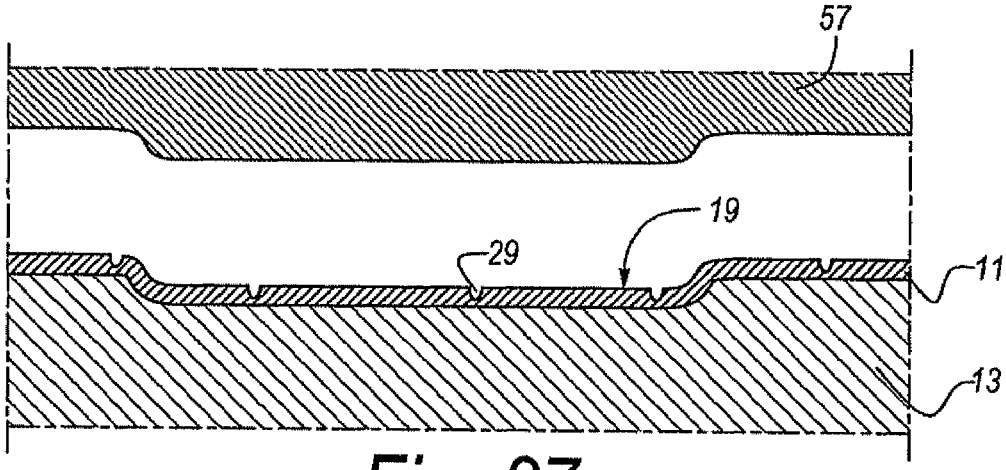
Figure 28:
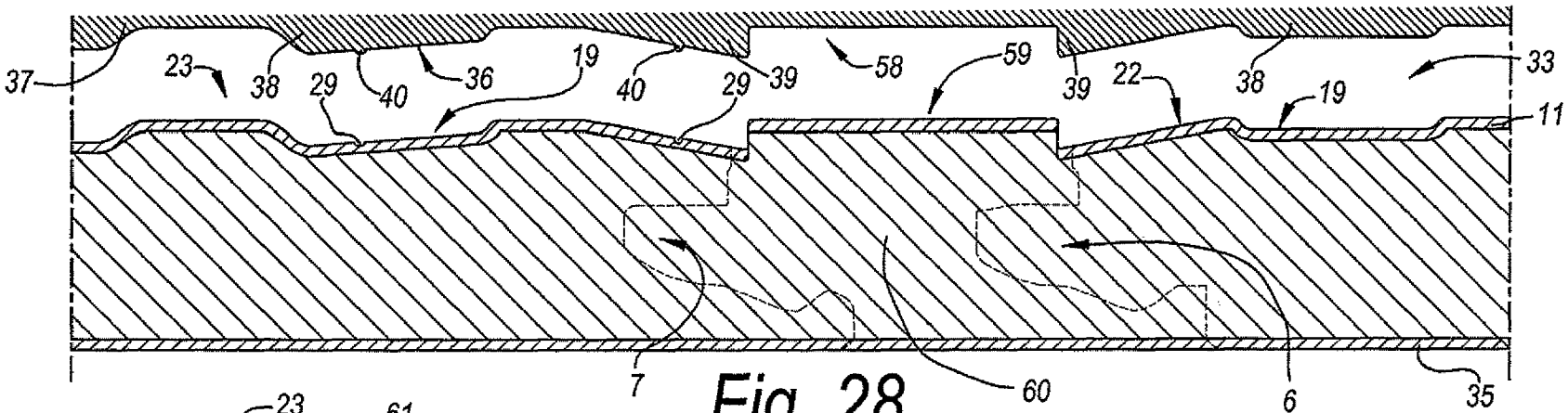
Figure 29:
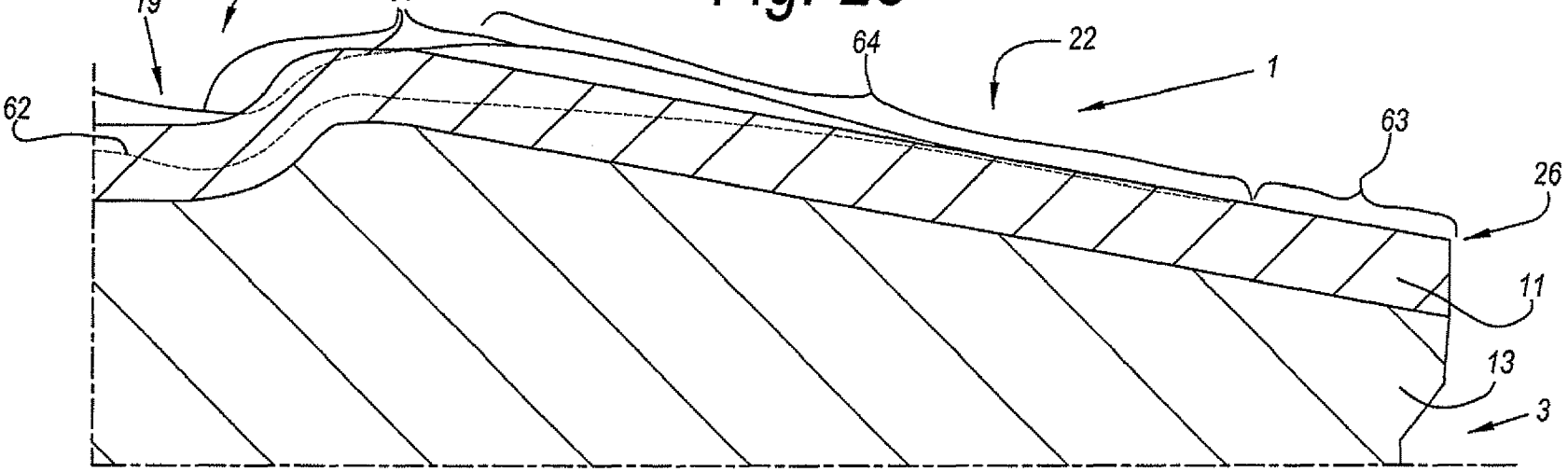

With the intention of better showing the characteristics of the invention, hereafter, as an example without any limitative character, several preferred forms of embodiment are described, with reference to the accompanying drawings, wherein:

FIG. 1 schematically and in perspective represents a floor panel according to the invention;

FIGS. 2 and 3, at a larger scale, represent cross-sections according to lines II-II and respectively, in FIG. 1;

FIG. 4, schematically and at a strongly enlarging scale, represents the part indicated by F4 in FIG. 3;

FIG. 5, at a larger scale and in perspective, represents the part indicated by F5 in FIG. 2;

FIGS. 6 and 7, at a larger scale, represent the parts indicated by F6 and F7 in FIG. 5;

FIG. 8, at a larger scale, represents a cross-section according to line VIII-VIII in FIG. 5;

FIG. 9, schematically and in perspective, represents a variant of a floor panel according to the invention;

FIGS. 10 and 11, at a larger scale, represent cross-sections according to lines X-X and XI-XI in FIG. 9;

FIG. 12 represents a variant for the part indicated by F12 in FIG. 10;

FIGS. 13 and 14 schematically represent two steps of a method for manufacturing a floor panel according to the invention;

FIG. 15, schematically and in cross-section, represents a view of two coupled floor panels according to the invention;

FIG. 16 represents a view similar to that of FIG. 15, however, for a variant;

FIGS. 17 to 24 schematically represent several methods for realizing accessories for manufacturing floor panels according to the invention, more particularly for manufacturing a press plate;

FIGS. 25 to 27 schematically represent three steps of an alternative method according to the present invention;

FIG. 28, in cross-section, represents a portion of a board, from which several floor panels according to the invention can be obtained, together with a portion of the pertaining press plate;

FIG. 29, at a larger scale, represents a variant of FIG. 7.

DETAILED DESCRIPTION OF THE PREFERRED EMBODIMENTS OF THE INVENTION

As represented in FIG. 1, the invention relates to a floor panel 1 of the type intended for forming a floating floor covering.

This floor panel 1 is provided, at two opposite edges 2-3, and even better, as represented in FIGS. 2 and 3, at both pairs of opposite edges 2-3 and 4-5, with coupling parts 6-7 and 8-9, with which several of such floor panels 1 can be coupled to each other. As represented, these coupling parts 6-7 and/or 8-9 preferably are of the type, which, in coupled condition of the floor panels 1, effects a locking in vertical and horizontal directions.

As represented in FIG. 4, the floor panel 1 comprises at least a decor 10 and a top layer 11, also called laminate layer, on the basis of synthetic material 12, as well as an underlying substrate 13.

In the represented example, the top layer 11 is performed as a DPL laminate that, as is represented in greater detail, however, in a schematic manner, in FIG. 4, is formed of two layers pressed upon each other and upon the underlying substrate 13, namely a first layer 14, generally called decor layer, consisting of a carrier 15 impregnated with synthetic material 12, more particularly resin, for example, a carrier made of paper, upon which the decor 10 is provided in the form of a print, and a second layer 16 consisting of a carrier 17 impregnated with synthetic material 12, more particularly resin, said carrier 17 mostly also consisting of paper. Hereby, the second layer 16 forms a so-called overlay, which, as known, becomes transparent during pressing, such that the decor 10 becomes visible. In this overlay, materials that enhance the wear resistance of the final top layer 11 can be included in a known manner.

In FIGS. 2-3 and 5 to 8, the top layer 11, for simplicity's sake, has been depicted as only one layer, which, moreover, in relation is represented excessively thick. In reality, this top layer preferably shall have a thickness that is less than 0.2 millimeters.

In the represented form of embodiment, the underlying substrate 13 also forms the actual core of the floor panel 1. However, it is not excluded that an underlying substrate is applied that as such is attached to an actual core or that forms an upper layer of a composed core. Preferably, the substrate 13 consists of a product on the basis of wood, preferably wood fiberboard, and, in the most preferred form of embodiment, MDF or HDF.

The top layer 11, including the decor 10, preferably is situated directly on top of the substrate 13, although the application of other intermediate layers is not excluded, such as, for example, sound-dampening layers or layers with another purpose.

It is also clear that the top layer 11 can comprise more or less layers than described above. So, for example, the top layer, in case it is of the DPL type, can be provided with one or more additional overlays and/or an additional decor layer and/or a so-called underlay, which is an additional resin-impregnated carrier that is applied beneath the aforementioned decor layer 14.

Although the invention is intended in particular for being applied with laminate floor panels of the DPL type, it is not excluded to apply it also with other kinds of laminate floor panels, for example, of the HPL type (High Pressure Laminate), whereby the top layer then mostly indeed will be thicker than 0.2 mm.

The invention is also in particular intended for embodiments whereby the synthetic material 12 of the top layer substantially consists of thermo-setting resin, more particularly melamine resin.

The above, however, does not exclude that the top layer can also consist of another synthetic material and is provided on the surface in another manner than in the manners usually applied for DPL and HPL. So, for example, may the synthetic material consist of a substance applied in liquid form, which is hardened, such as a transparent lacquer, varnish or the like. Also, the decor 10 can consist of a substance printed directly on the substrate, preferably in the form of a pattern printed with ink, for example a wood pattern, beneath which possibly one or more primers, for example, paint primers, are provided.

As is represented in FIGS. 1 to 8, the floor panel 1, in accordance with the first aspect of the invention, forms an imitation of wood from which wood portions have been removed from the surface by means of a tool, more particularly an imitation of so-called scraped wood. Hereby, this floor panel 1 comprises a decor 10 representing a wood pattern 18 and is the floor panel 1, in the surface over which the decor 10 extends, provided with embossed portions 19-20 that continue up into the aforementioned substrate 13, whereby these embossed portions 19-20 are at least applied to imitate the aforementioned removed wood portions.

In the represented example, two kinds of such embossed portions, 19-20, respectively, are represented. On the one hand, this relates to the portions 19, which are performed as sunk portions imitating wood portions removed from the surface, and, on the other hand, this relates to the portions 20 forming a deeper-situated edge area 21, which comprises at least a sloping edge portion 22. In both cases, the embossed portions 19-20 continue up into the substrate 13, by which is meant that, at the location of these embossed portions 19-20, also a local embossment of the substrate, and thus preferably of the MDF or HDF, takes place.

It is noted that the embossed portions 19 are portions covering preferably in their majority a substantial surface, and that no small embossments are concerned, such as embossments for imitating wood pores. Hereby, substantial portions are concerned, which preferably extend over a surface that is larger than 0.5×0.5 cm.

Although in the represented example as well the embossed portions 19 representing local sunk parts, as well as the embossed portions 20 representing lower-situated edge areas 21 with a sloping portion 22, are performed in accordance with the first aspect of the invention, it is not excluded that only one of both kinds of embossed portions 19 or 20 is applied, or even other kinds of embossed portions are applied, such as, for example, embossed portions imitating a joint in the center of the floor panel, for example, when one panel imitates two or more planks.

Also, according to the first aspect, it is not excluded to realize certain of the aforementioned embossed portions 19 and/or 20 by such a deep embossment that they continue up into the substrate and thereby, as explained above, fulfill the first aspect, whereas certain other embossed portions are realized by less deep performed embossments, for example, by means of an embossment in the top layer 11 only. So, for example, the embossed portions 19 might be performed up into the substrate, whereas the embossed portions 20 are realized exclusively according to a deformation, more particularly a local compression, in the top layer 11, or vice versa.

According to the first aspect of the invention, the embossment of the substrate itself, which is indicated by D1 in FIGS.

4, 6 and 7, preferably shall be at least 0.4 and better at least 0.5 millimeters. However, preferably the embossment D1 is smaller than 1.5 millimeters.

The form of embodiment represented in FIGS. 1 to 8 is also made conform to the second aspect of the invention. To this aim, the depth D2 of the embossed portions 19-20, in other words, the height difference between the un-embossed upper side 23 of the floor panel 1 and the deepest point 24 of an embossed portion 19 or 20 concerned, is larger than the nominal thickness D3 of the top layer 11, more particularly laminate layer, that is situated above the substrate 13. Preferably, this is valid for the embossments 19 representing locally removed wood portions, as well as for the embossments 20 with which the deeper located edge areas 21 are formed. This does not exclude that this second aspect can be applied for only one of the two kinds of embossed portions 19 or 20.

Preferably, the floor panel will also be realized conform to the third aspect. To this aim, the decor 10 itself, at the location of said embossed portions 19 and/or 20, shall be embossed at least over 0.4 millimeters and even better at least 0.5 millimeters. This means that in the representation of FIG. 4, the distance D4 then is at least 0.4, at least 0.5 millimeters, respectively.

It is clear that the represented form of embodiment of FIGS. 1 to 8 also forms an example of the aforementioned fourth aspect of the invention. After all, the floor panel, at one or more edges, in this case at all four edges 2-3-4-5, has a sloping edge portion 22 sloping towards the respective edge and extending over the surface of the aforementioned decor 10 and which is formed by means of an embossed portion 20, in other words, by a portion obtained by means of an embossment technique, and thus not by removing material.

Further, the form of embodiment represented in FIGS. 1 to 8 also forms an example of the fifth aspect of the invention. To this aim, the floor panel 1, as aforementioned, at one or more edges, in this case all edges 2-3-4-5, shows a deeper situated or sunk edge area 21, which extends over the surface of the aforementioned decor 10 and which is formed by means of embossment of the top layer 11 and possible underlying layers, such as the substrate 13, whereby this edge area 21 consists of a sloping edge portion 22, as well as a portion 25 extending between the respective edge of the floor panel 1 and the sloping edge portion 22, which portion 25 is flat or, seen as an average, slopes less than the aforementioned sloping edge portion 22.

It is noted that such portion 25 according to all other aspects is purely optional and that the sloping edge portion 22 also can terminate directly at the edge. Also, the edge portion 22, in all forms of embodiment concerned, may show a sloping, but bent, course instead of being realized in the form of a sloping plane.

Further, in FIGS. 1 to 8 also a number of preferred embodiment details are represented. These details, which are described below, are not specifically bound to well-defined aspects of the invention and thus can also be applied at random in combination with each of the aforementioned aspects.

FIGS. 1, 2 and 5 represent that, when imitating scraped wood or the like, among the embossed portions 19 preferably portions are present that extend in the form of longitudinal paths, which specifically are additionally indicated by reference 19A.

FIG. 5 also represents that, when imitating scraped wood, also local, more crosswise-directed embossed portions 19 can be applied, again separately indicated by 19B-19C.

FIG. 5 also shows that the embossed portions 19 as such can be present at the normal upper surface as well as in the sunk edge areas 21. As represented by portion 19C, such embossed portion even can merge from the actual upper surface into the sloping edge portion 22, which is illustrated in detail in FIG. 8.

The distances D2 indicated in FIGS. 6 and 7 preferably are at least 0.4 and better at least 0.5 mm. However, preferably they are also smaller than 1.5 millimeters, anyhow, at least when DPL is applied.

As indicated in FIG. 6, the sloping edge portion 22, viewed according to a cross-section transverse to the respective edge, preferably extends over a distance D5 of at least 3 mm and even better at least 5 mm, however, preferably less than 15 mm.

The largest angle formed by the portion 22 with the plane of the floor panel 1 preferably is smaller than 10 degrees and even better smaller than 5 degrees.

The portion 25 extending between the respective edge of the floor panel 1 and the sloping edge portion 22 preferably is substantially flat or completely flat and extends, as represented, preferably parallel to the main plane of the floor panel 1. This portion 25 is on option.

The distance D6 preferably is smaller than ⅓ of the distance D5. Further, D6 preferably, in which way whatsoever, is smaller than 2 millimeters.

Viewed in longitudinal direction and at the location of the upper edge 26 of the floor panel 1, the portion 25 extends parallel to the plane of the floor panel 1, such that mutually coupled floor panels 1 at their upper edges substantially always adjoin to each other over their entire length at the same height.

It is noted that the shape and/or angle of such sloping portion 22, viewed in cross-section, can alter in function of the longitudinal direction of the respective edge, whereby preferably at least the location where the actual upper surface or actual upper side 23 of the floor panel 1 merges into the sloping portion 22, varies laterally in function of the longitudinal direction. Hereby is meant that, as indicated in FIG. 5, the transition between the sloping portion 22 and the actual upper surface 23 does not manifest itself according to a straight line L1, but according to a line L2 varying laterally in position and preferably being irregularly curved.

In the figures, the deeper situated or sunk edge areas 21, and more particularly the sloping edge areas 22, are applied at all four edges 2-3-4-5. It is clear that this might also be possible at only two opposite edges, which, in the case of oblong floor panels 1, then preferably are the longitudinal edges.

FIGS. 9 to 11 represent a form of embodiment in which the sixth aspect of the invention is applied, in other words, whereby at one or more of the edges 2 to 5 one or more visual edge effects are combined with an effectively sloping edge portion 22.

As represented, to this aim a shadow effect 27 can be depicted in the decor 10, whereby the represented shadow, at the location of an edge area, extends over the wood pattern 18 also represented by the decor 10.

Preferably, the shadow is such that it underlines the effect of a sloping edge.

The shadow preferably extends over a width B of at least 0.5 cm. Also, preferably it continues over the flat portion 25.

In the case that the floor panel 1 is rectangular, thus, square or oblong, it is preferred that both pairs of opposite edges 2-3 and 4-5 each have one edge, 2 and 5, respectively, provided with such shadow, whereas the other edge, 3 and 4, respectively, of each pair does not have a shadow or does have a less pronounced shadow.

The shadow may run gradually, for example, in such a manner that it becomes darker to the extent that the surface of the pertaining embossed portion 20 is located deeper.

In general, it is noted that such shadow can also be applied in embossed portions 19, which imitate removed wood portions, for example, by imitating scraped wood, whereby then, for example, a shadow at the edges of embossed portions can be represented in the decor 10.

Another possibility of a visual edge effect according to the invention is represented in FIG. 11 and consists in that, in the case that the decor 10 represents a wood pattern 18, in the respective edge area an image 28 of crosscut wood is represented in the decor 10, such at the location of an effectively sloping edge portion 22.

As represented, both forms of visual edge effect can be combined with each other.

It is also clear that the above-described visual edge effects can be integrated in floor panels according to the first to the fifth aspect. Hereby, this can, but does not have to be in combination with a sloping edge portion 22. The visual effects may, for example, also be applied to a flat upper side.

The application of an image 28 of crosscut wood, represented in the decor itself, of course in combination with a wood pattern 18, as such also forms an independent inventive aspect. An advantage obtained thereby is that a visual depth effect is created in the decor itself in an unobtrusive manner.

As illustrated in the FIGS. 5 to 8 and 10-11, in the upper side of the floor panel 1 also embossments 29 are provided that imitate wood pores, which preferably correspond to the wood pattern 18, which as such is known as "registered embossed".

As represented, the embossments 29 imitating the wood pores can be provided in the flat upper side as well as in the aforementioned embossed portions, and more particularly in the edge areas 20 and/or the portions 19 intended for imitating locally removed wood portions.

Preferably, the depth of the embossments 29 imitating the wood pores is smaller than the nominal thickness of the aforementioned top layer or laminate layer 11.

According to FIGS. 1 and 9, the floor panels 1 show the same wood pattern 18 that extends over the entire panel, such that one floor panel 1 forms a representation of one one-piece wooden plank. However, it is not excluded to imitate, according to a variant, more than one plank on one floor panel 1.

In the forms of embodiment of FIGS. 1 to 11, the floor panel 1, at all sides, has upper edges 26, which, when joining two of such floor panels 11, adjoin against each other, whereby the decor 10 extends up to these upper edges. This does not exclude that according to a variant, use can be made of one or more upper edges, a material portion of which is cut off in order to form a bevel or the like, whereby the decor at these edges extends up to the cut-off portion. An example thereof, whereby a covering 31 is provided on the surface 30 of the cut-off portion, is illustrated in FIG. 12.

FIG. 12 also illustrates a further inventive effect that can be applied independently, namely that a sloping embossed edge portion 22 merges into an edge portion 32, such as a bevel, which is obtained by removing a material portion. Hereby, it is useful that the adjoining at the edges becomes less critical than with inclined edge portions directly adjoining each other.

The floor panels 1 are manufactured of large boards, more particularly laminate boards, which are cut to floor panels 1, after which, at the edges thereof, in a known manner coupling parts, for example, the represented coupling parts 6-7-8-9, are formed, for example, by means of a number of milling operations.

The boards 33 themselves are, for example, manufactured, as schematically indicated in FIG. 13, by compressing the various composing layers under high pressure in a heated press 34, whereby, for example, the decor layer 14, the overlay 16 and a backing layer 35 are pressed onto the substrate 13 and thereby are hardened. The structure or the relief of the upper surface of the board 33 and thus also of the upper side of the floor panels 1 is determined by the structure or relief of the contact surface 36 of a press plate 37 applied in the press 34. Such press plate 37 is known better under the denomination "platen".

As schematically indicated in FIG. 13, it is clear that the contact surface is provided with the necessary relief for forming the aforementioned embossed portions and embossments. So, this contact surface, for example, has a first relief, formed by projecting portions 38-39, respectively for forming the embossed portions 19-20, as well as a finer relief, formed by projections 40, for forming the embossments 29.

In practice, the boards 33 and the press plate 37 have dimensions of, for example, 2.5×5 meters or larger. The thickness of the press plate 37 mostly is 0.5 to 1 cm.

It is noted that according to a particular independent aspect of the invention, when sawing the boards 33, the saw cuts are realized in function of the precise position of the embossed portions and not in function of the image in the decor. In this manner is obtained that the saw cuts can always be realized at the same location in respect to the embossed portions. This is particularly important in the case that one works with lower-situated edge areas comprising a sloping portion. After all, when, for example, a decor layer 14 is used, this layer is subject to stretching. If then saw cuts are realized on the basis of the decor, the saw cuts are no longer in a well-defined position in respect to the embossed portions, as a result of which it is no longer possible to guarantee that the final upper edge 26 will always be situated at the same height. It then can vary in position, as a result of which it can be, at one floor panel, situated higher on the sloping portion 22 than at the other floor panel 1.

The sawing of the boards 33 in function of the embossed portions is schematically illustrated in FIG. 14, in which is shown that the saws 41 all run at the same location through the embossments formed by means of the projecting portions 39. Positioning the saws 41 in respect to the boards 33 preferably is performed automatically by means of one or more marks provided in the boards 33 during pressing. In FIG. 13, for example, a recess 42 is represented, by means of which such mark can be realized in the boards 33.

In the case that one works with sloping edge portions 22, preferably, as aforementioned, flat portions 25 are applied. In doing so, too, it is obtained that possible height differences at the upper edges 26, which might occur as a result of production tolerances when forming the edges, are excluded or at least minimized. This is schematically illustrated in FIGS. 15 and 16. FIG. 15 shows an embodiment, whereby the left floor panel 1 is made properly, but whereby the right-hand floor panel 1 is sawn and milled somewhat offset as a result of production tolerances. In the represented example, this leads to that the flat portion 25 of the right-hand floor panel 1 shows a smaller width B1 than the normal width B2. Because the portions 25 are flat, the upper edges 26 of the floor panels 1 still adjoin each other at the same height. In case that the same deviation would occur with an embodiment without the flat portions 25, this would result in an undesired height difference at the upper edges 26, as illustrated in FIG. 16. This does not exclude that embodiments, for example, according to FIG. 16 are subsumed under the invention.

Indeed, it is such that, when applying modern machinery, the deviations created by tolerance differences will lead to minor height differences only, such that these will be not or almost not noticeable in a floor covering and that embodiments, such as, for example, according to FIG. 16, thus, without the aforementioned flat portion 25, may lead to a satisfying result as well.

In FIGS. 17 to 24, schematically some particular techniques for preparing a press plate 37 are represented. These techniques, which were already described in the introduction, are in particular suited for realizing a press plate with which the aforementioned floor panels 1 can be manufactured.

More particularly, it is represented in FIGS. 17 to 24 how the press plate 17 can be provided with the aforementioned "first" and "second relief".

Figure 17:
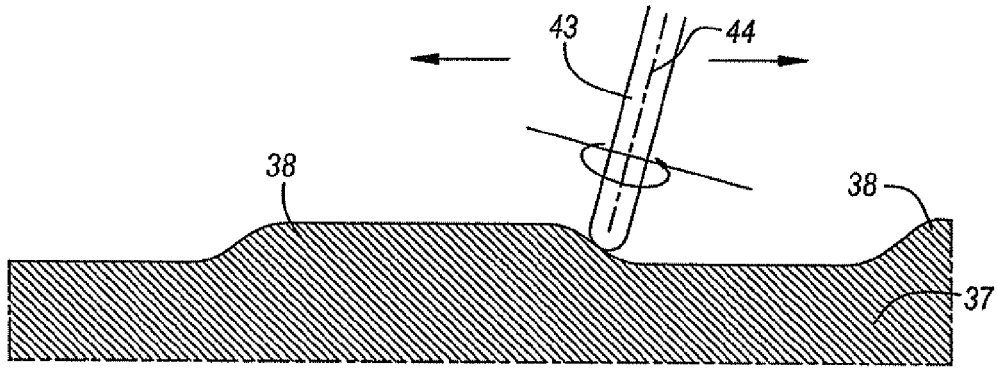

FIG. 17 represents that the first relief preferably is realized by means of a machining treatment with a mechanical tool 43 at the surface of the pressure plate 37. As represented, to this aim preferably a milling cutter, more particularly a round-head milling cutter, is applied. This milling cutter preferably is situated with its axis of rotation 44 always or almost always at an angle with the surface where it comes into contact. With this first relief, for example, the projecting portions 38 and 39 are formed.

Figure 18:
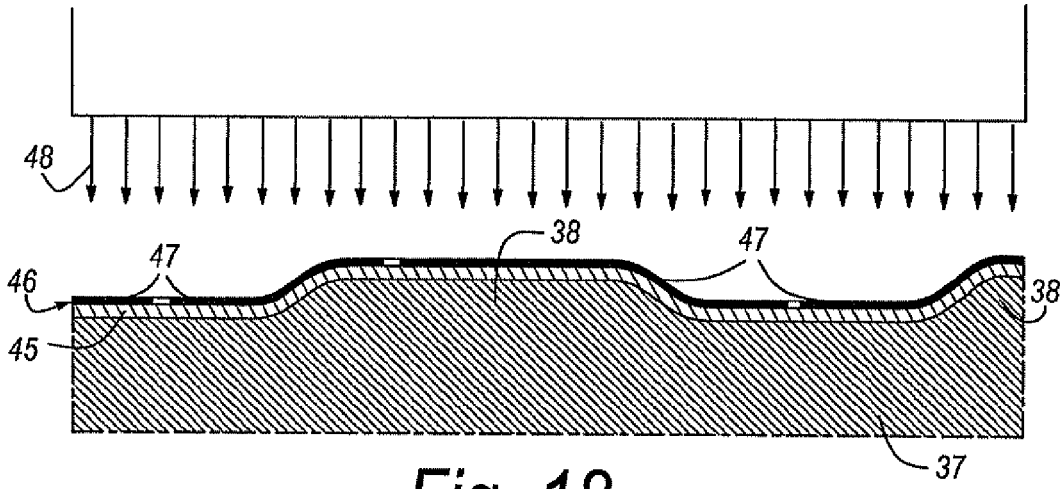
Figure 19:
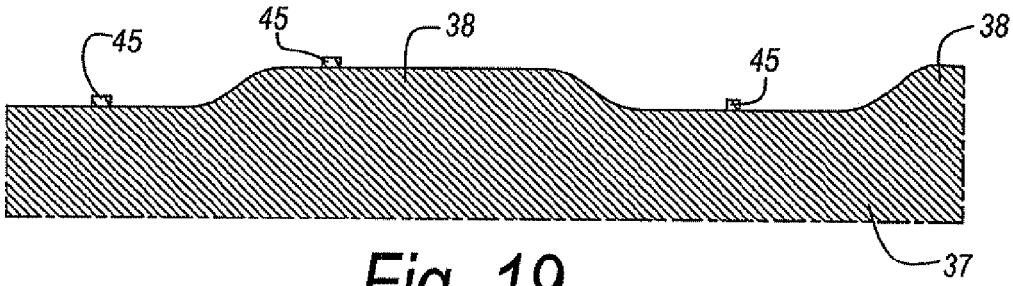
Figure 20:
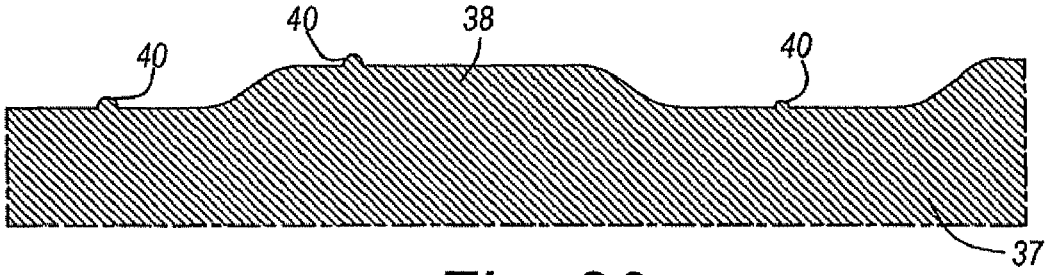

FIGS. 18 to 20 show a first possibility for superposing a second relief upon the first by means of an etching technique.

According to this first possibility, as represented in FIG. 18, a substance 45 that can be hardened by means of radiation, more particularly by means of light, such as UV light, preferably in the form of a gel, is provided over the surface of the press plate 37 to be etched, whereby this substance 45 continuously extends over the normal as well as the projecting portions 38-39 of the surface. Subsequently, a film 46 is provided over this substance 45, which is provided with a print 47 or the like, with portions that are impervious to said radiation, whereby this film 46 is forced to follow unevennesses in the substance 45, preferably by drawing the film against the substance 45 by means of vacuum drawing. Subsequently, the suitable radiation 48, for example, UV radiation, is left to effect on the whole, such that the portions of the aforementioned substance 45 that are accessible to the radiation are hardened. After removing said film 46 and the unhardened portions of the substance 45, a condition is obtained as in FIG. 19. By subsequent etching, a press plate 37 is obtained that is provided with projections 40, as illustrated in FIG. 20.

According to a second particular possibility, systematically, directly or indirectly, a protective pattern is built up on the press plate, preferably by means of a device moving in respect to the press plate, which device is digitally controlled. Three examples of forms of embodiment thereof are illustrated in a highly schematized manner in FIGS. 21 to 23.

Figure 21:
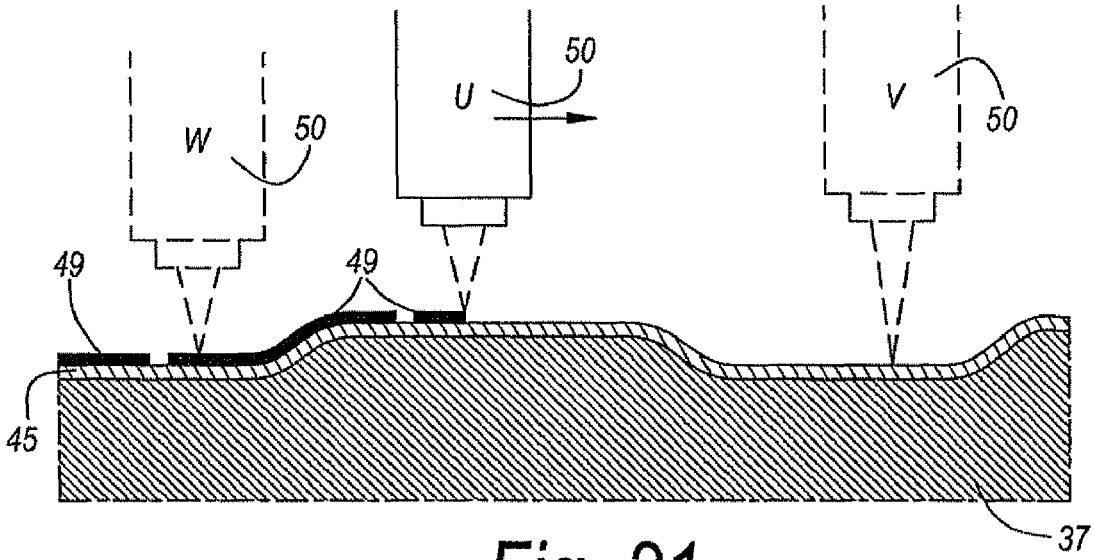

According to the first form of embodiment, as represented in FIG. 21, a substance 45 that can be hardened by means of radiation, more particularly by means of light, such as UV light, preferably in the form of a gel, is provided over the surface of the press plate 37 to be etched, whereby this substance 45 continuously extends over the normal as well as the projecting portions 38-39 of the surface. Subsequently, systematically and in the form of a pattern, a substance 49 is deposited on the substance 45, such that certain zones become impervious to said radiation. By now having the suitable radiation, for example, UV radiation, effect on the whole, the portions of the aforementioned substance 45 that are accessible to the radiation are hardened. After removing the unhardened portions of the substance 45, again a condition is obtained as in FIG. 19, after which one proceed in an analogous manner. The protective substance 49 must be sufficiently radiation-resistant against the applied radiation. This can be an UV-resistant ink. The applied device can be a printer, the printer head 50 of which is moved over the press plate 37, either because the printer head 50, or because the press plate 37, or because both are movable.

Figure 22:
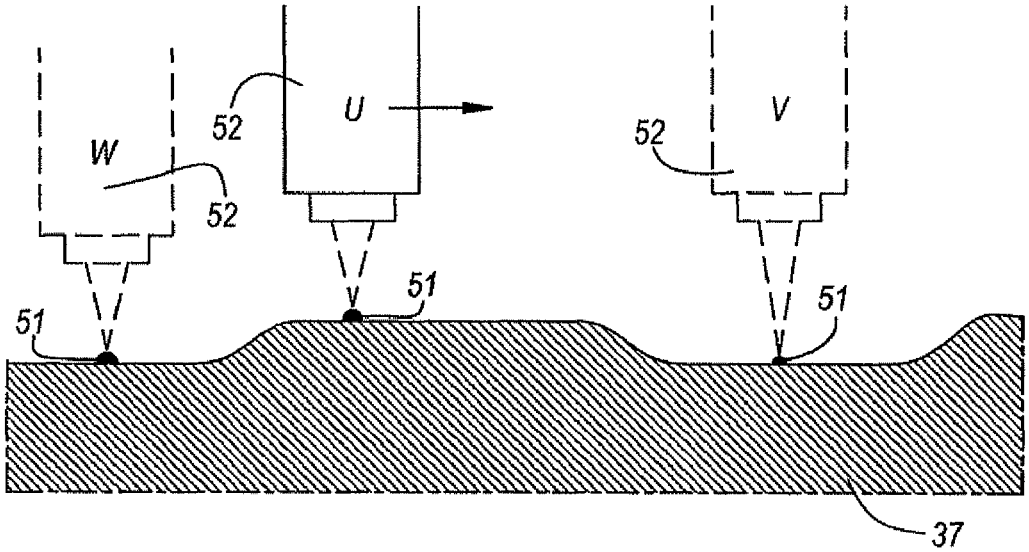

According to the second form of embodiment, which is schematically illustrated in FIG. 22, a substance 51 that is resistant against etching agent is provided directly on the press plate 37, in the form of a pattern, by means of a digitally controlled application device 52, such that certain zones of the press plate are covered. Hereby, directly a condition as represented in FIG. 19 is obtained, after which one proceeds in an analogous manner.

The application device 52 can be a printer, for example, an inkjet printer, which then sprays a protective substance for etching agents onto the press plate instead of the usual ink, according to the desired pattern. It is clear that this substance must be resistant against etching agent.

Figure 23:
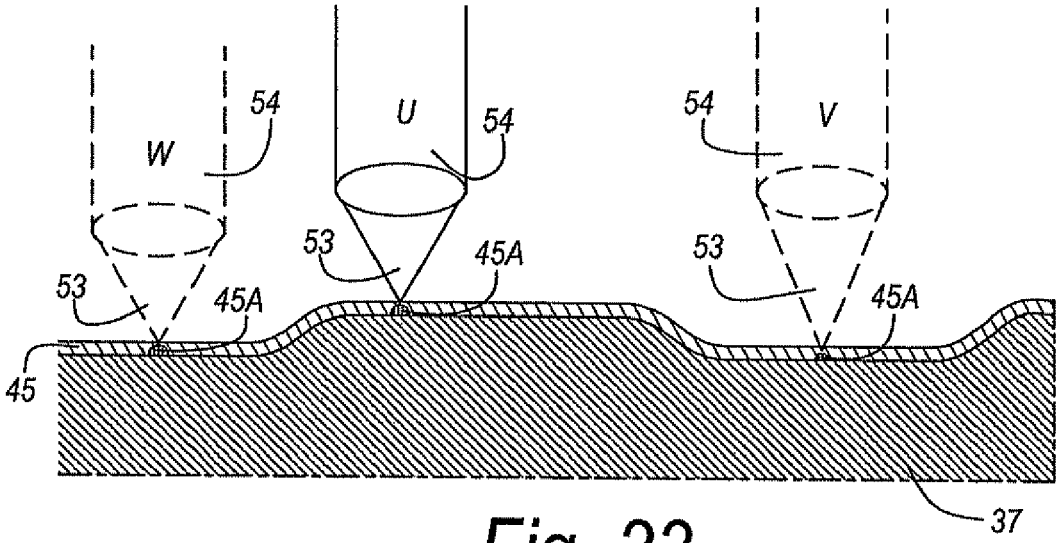

According to the third form of embodiment, which is schematically illustrated in FIG. 23, a substance 45 that can be hardened by means of radiation 48, more particularly by means of light, such as UV light, preferably in the form of a gel, is applied over the surface of the press plate 37 to be etched, whereby this substance 45 continuously extends over the normal as well as the projecting portions 38-39. Subsequently, by means of selectively radiating the substance 45 by means of the suitable radiation 53, hardened portions are realized, which are indicated by 45A. After removing the un-hardened portions of said substance 45, directly a condition as illustrated in FIG. 19 is obtained, after which one proceeds in an analogous manner. The radiation can be generated by a radiation source 54, for example, a UV lamp. Hereby, the radiation, for example, is suitably focused, or a focused beam of light is applied, possibly a laser beam.

In the forms of embodiment of FIGS. 21 to 23, it is preferred that use is made of auxiliary means that move over the surface of the press plate, or vice versa, and which adapt directly or indirectly in function of the position of the surface in respect to these auxiliary means. According to a possibility, the adaptation may take place by means of a focus adjustment. According to another possibility, this takes place by means of a distance adjustment in respect to the press plate.

The above means, for example, that in FIG. 21 the printing focus of the printer head 50 and/or the distance to the basic plane of the press plate can be altered. In position V, thus a condition is represented whereby the print focus is altered in respect to position U. In position W, a condition is represented whereby the distance of the printer head to the basic plane of the press plate 37 is altered in respect to position U, and this such that the distance to the surface or, thus, the printing distance, remains constant.

In FIGS. 22 and 23, similar possibilities are represented for the positions U-V-W, however, then for the application device 52 and the radiation source 54.

Figure 24:
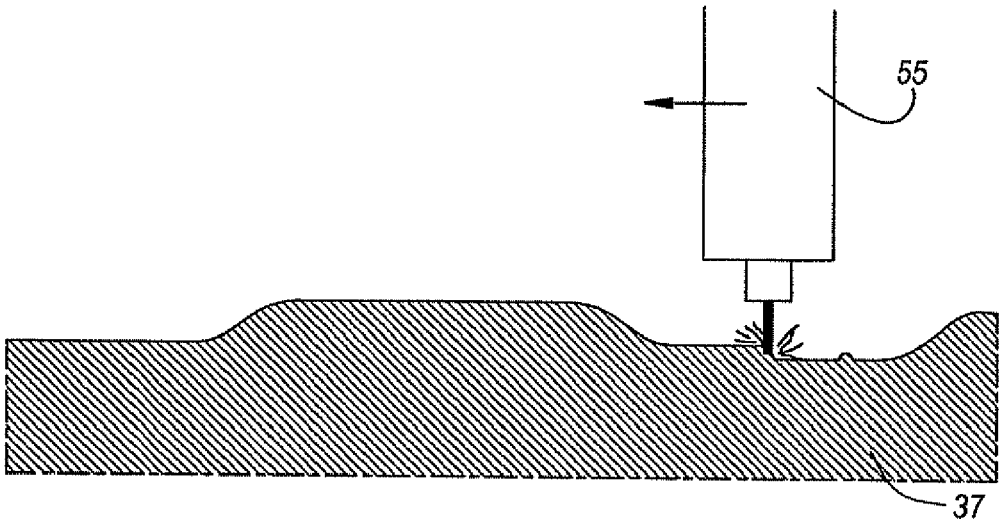

According to another possibility than etching, the second relief is realized by means of a controlled, preferably digitally controlled, material-removing process, for example, by means of spark erosion, and more particularly by means of so-called spark milling. FIG. 24 schematically represents this technique, whereby a spark milling apparatus 55 removes a certain amount of material, whereas thereby projections 40, where no material is removed, are formed.

According to a not-represented variant, instead of systematically removing material from the press plate, also material can systematically be deposited on the press plate, in order to thereby build up, for example, the projections 40. Of course, all obtained press plates subsequently can be polished or the like.

According to a particular method of the invention, the floor panels, and more particularly the boards from which the floor panels are formed, are realized by means of at least two press cycles instead of only one press cycle. Hereby, the floor panels, and more particularly the boards from which they are manufactured, are provided with a final relief in at least two press treatments. Hereby, one can proceed as schematically illustrated in the FIGS. 25 to 27, in this case, when manufacturing boards of the DPL type.

FIG. 25 shows that in a first press treatment at least the substrate 13, the decor layer 14 and the overlay 16 are brought under a press plate 56. As represented in FIG. 26, after pressing a top layer 11 is created. Hereby, a relief is realized in the surface of the floor panels or boards, which substantially consists of embossments 29 extending substantially exclusively in the top layer of synthetic material, without the substrate being substantially deformed.

In a second press treatment then, as illustrated in FIG. 27, larger embossed portions, such as the portions 19, are realized in the floor panels or boards, which preferably do continue up into the aforementioned substrate. To this aim, a second press plate 57 is applied.

The second press treatment can be performed cold as well as warm. In the case that heat is utilized in the second press treatment, this may take place as well by bringing the boards into the press in warm condition, as well as by working with a heated press, as well as by applying both heating techniques.

Contrary to all expectations, the inventor has found that the embossments that are realized in the first press treatment, are not undone in the second press treatment.

It is clear that this method can be employed for realizing the above-described floor panels, as well as other floor panels.

It is noted that the invention also relates to devices directly or indirectly applied when manufacturing the floor panels, more particularly relates to the devices described with reference to FIGS. 17-24 in respect to the aforementioned method.

For controlling the tool 43, one can start from digital data obtained by scanning a real model. Preferably, to this aim use is made of a model especially designed beforehand, for example, a model formed of MDF or HDF. By scanning this model, then the data for the 3D control of the tool 43 are obtained.

The aforementioned substance 45 can be provided on the press plate 37 in any manner. Preferably, this takes place by immersion.

In FIG. 28, another particular form of embodiment is represented, whereby the press plate 37, between the projecting portions 39 intended to provide embossed portions 20 in the board 33, the floor panels 1, respectively, comprises recesses 58. As represented in FIG. 28, such recesses 58 result in areas 59 at the upper side 23 of the board 33 that are not or almost not embossed, or at least are less embossed than the surrounding areas on the board 33. During the press treatment, the applied pressure will build up less in this area 59 than in the aforementioned surrounding areas, in the example of FIG. 28 less than in the sloping edge portions 22, and consequently possible porosities in the top layer 11 will tend to manifest themselves exclusively at the height of this area 59. So, for example, air bubbles that are trapped in the synthetic material 12 or resin will be driven towards this area 59, where they will result, for example, in a white shine or spot that obscures the decor 10. Thus, it is clear that these areas 59 preferably situate themselves exclusively in the portion 60 of the board 33 that is intended to be removed by means of, for example, sawing and milling treatments, when forming the floor panels 1 from this board 33. The coupling parts 6-7 to be formed thereby are indicated by dashed line in FIG. 28.

It is not excluded that the top layer 11 cracks at the edges of the areas 59, in particular in the case when the recess 58 has rather steep edges. However, this does not pose a problem, as these cracks normally then will be situated in the portion 60 to be removed.

It is noted that the inventors thereby have succeeded in having porosities occur in a controlled manner by concentrating the occurrence of this normally undesired and to be avoided effect to areas 59 of the board 33 of which the material is not applied for the floor panels 1. The application of recesses 58 in a press plate 37 with the intention of concentrating the occurrence of porosities in well-defined areas 59 may lead to a lower required pressing pressure and pressing time and, thus, to a lower energy consumption when manufacturing floor panels 1.

Thus, according to a special independent aspect, the present invention relates to a press plate 37 for manufacturing a board 33 that comprises a top layer 11 on the basis of synthetic material 12 and an underlying substrate 13, whether or not composed of several layers or parts, and from which floor panels 1 are formed, with as a characteristic that the press plate 37 is provided with means in the form of recesses 58, such that the occurrence of porosities in said top layer 11 as a result of a press treatment performed with the press plate 37 is concentrated to the areas 59 on the board 33 corresponding to the aforementioned recesses 58. Preferably, the aforementioned recesses 58 are such that the areas 59 on the board 33 corresponding to the recesses, where the occurrence of porosities concentrates, are situated in portions 60 of the board 33 that are removed when forming said floor panels 1.

FIG. 29 represents another form of embodiment of said sloping portion 22, whereby, seen in cross-section, the shape and/or location of the transition between the actual upper side 23 of the floor panel 1 and the sloping portion 22 varies in function of the longitudinal direction. Apart from the upper side 23, represented in cross-section, the lines 61 and 62 represent how this upper side 23, and in particular this sloping portion 22, can, for example, change their shape in function of the longitudinal direction. To this aim, the lines 61 and 62 are representations of the upper side 23 at a random distance behind the plane of FIG. 29.

It is noted that according to a particular aspect that also is represented in FIG. 29, the sloping portions 22 as such preferably are built up of at least two portions, a first portion 63 adjoining to the upper edge 26 of the floor panel and/or the edge of the top layer 11 and whereby the shape of this first portion 63, seen in cross-section, is constant or almost constant in function of the longitudinal direction, this over the majority of the length of the respective edge, and a second portion 64, respectively, which preferably extends from the first portion 63 up to the transition towards the upper side of the panel, the shape of which, seen in cross-section, varies in function of the longitudinal direction.

The utilization of the portions 63 and 64 is of particular importance, as it allows a large freedom of design of the upper surface or upper side 23, as the shape of the portion 64 then can be optimally chosen in function of the transition towards the upper side 23 that has to be realized, whereas a good adjoining of the floor panels 1 remains enabled, as an upper edge 26 that is straight in respect to the longitudinal direction can be guaranteed at the height of the portion 63, and more particularly at the height of the upper edge 26. Thereby is meant that height variations in longitudinal direction at the upper edge 26 of the floor panel 1 are avoided, such that, when coupling with a similar floor panel 1, no undesired height differences will occur between the two coupled floor panels 1. It is noted that the portion 63 can have a very small width.

According to a particular characteristic of the invention, the embossed portions 19 and/or 20 preferably are realized by means of a press plate, the shape of which, at least for these portions 19 and/or 20, is derived from scanned-in models, more particularly scanned-in wood parts or the like.

When at the edge of the floor panel 1 two parts 63 and 64 are applied, as described above, it is preferred that the portion 64 substantially is obtained by means of scanning-in a model and forming thereof a substantially corresponding portion at the press plate, whereas the portion 63 is realized on the basis of digitally introduced data, which are fixedly determined beforehand. Further, it is preferred that the thus obtained data in the portions 63 and/or 64 and/or in a possibly intermediate portion are manipulated additionally, such that a desired, preferably unobtrusive transition between the portions 63 and 64 is obtained, in other words, such that these portions 63 and 64 smoothly merge into each other. Further manipulations of data are not excluded, for example, in order to filter general deformations in scanned-in models out of the obtained data.

It is noted that the invention also relates to floor panels whereby each panel as such represents more than one plank, whereby the aforementioned sloping edge portions then also can be formed between each representation of two planks on one floor panel.

The floor panels can be realized in various thicknesses. Preferably, the thickness thereof is between 6 millimeters and 15 millimeters.

It is not excluded to form the aforementioned finer relief by means of a structured foil that is applied between the press plate and the boards 33, instead of using a relief that is present at the press plate itself.

Also, it is not excluded to provide embossments 29 that go deeper than the thickness of the top layer 11, whereby this top layer possibly is pricked through.

The aforementioned embossed portions, whereby embossments are formed that continue up into the substrate, can be realized by means of normal pressing pressures. However, it is preferred that higher pressures than the usual pressures are applied. More particularly, pressing pressures of more than 77 bar shall be applied. By applying such high pressures, the risk of porosity effects occurring in the top layer is minimized.

Possibly, however, not necessarily, a heavier overlay can be used in the top layer than is usual when manufacturing DPL floor panels, in order to compensate for a higher risk of premature wear. Preferably, use shall be made of an overlay with a carrier paper having at least a weight of 80 g/m$^2$.

It is noted that the term "pore structure" according to the present application can be interpreted both narrow as broad. By a narrow interpretation is understood that only the wood pores are concerned. By a broad interpretation must be understood that wood pores as well as other finer structures of wood are concerned, such as wood nerves and the like. It is clear that the embossments 29 for forming such pore structure then also are realized accordingly.

Further is noted that by a "sunk edge area", each edge area has to be understood that has a surface that is situated lower than the normal upper surface 23 of the floor panel 1.

It is noted that the depth of the realized embossed portions does not necessarily correspond to the size of the projecting portions at the press plate 37. In practice, the substrate, after embossing, mostly will jump back somewhat. The projecting portions can be of different height. Preferably, however, they have a maximum height of 0.8 to 1 millimeter in DPL applications.

The present invention is in no way limited to the forms of embodiment represented as example; on the contrary, the aforementioned floor panel, the aforementioned methods, devices and accessories for manufacturing, amongst other, such floor panel, can be realized according to various variants, without leaving the scope of the invention.

The invention claimed is:

1. Method for manufacturing floor panels; said floor panels having an upper surface and at least comprising:

a printed decor extending over a substantial part of said upper surface; and a top layer on the basis of synthetic material;

a substrate whereupon said printed decor and said top layer are provided; said substrate having at least two opposite edges along the upper surface; wherein said floor panels are manufactured starting from boards; said boards at least comprising said substrate; wherein said method at least comprises the step of providing said floor panels with a final relief; said step at least including a first press treatment and a second press treatment; said first press treatment providing a first relief in said upper surface; said first relief comprising embossments extending exclusively in said top layer; said second press treatment providing a second relief in said upper surface; said second relief comprising embossed portions which continue up into the aforementioned substrate;

wherein the first and second press treatments are performed separately from one another;

wherein the printed decor is applied to the upper surface and extends to the at least two opposite edges before the second relief is applied;

wherein the printed decor continuously extends over and along the embossed portions of the second relief so as to follow the contours of the embossed portions.

2. The method of claim 1, wherein said second press treatment is performed after said first press treatment.

3. The method of claim 1, wherein said substantial part of said upper surface over which said decor extends comprises said embossed portions of said second relief.

4. The method of claim 1, wherein said floor panels are of the Direct Pressure Laminate (DPL) type and wherein during said first press treatment said top layer is provided on said substrate.

5. The method of claim 1, wherein said second press treatment is a heated press treatment.

6. The method of claim 1, wherein said second relief includes embossed portions forming a sunk edge area located at least at one of said two opposite edges.

7. The method of claim 6, wherein said sunk edge area comprises a sloping portion.

8. The method of claim 6, wherein said sunk edge area comprises a sloping bent portion.

9. The method of claim 1, wherein said substrate consists of MDF or HDF.

10. The method of claim 1, wherein said substrate comprises a compacted region located at said embossed portions of said second relief.

11. The method of claim 10, wherein said substrate comprises locations without embossments; said compacted region being compacted more than said locations without embossments.

12. The method of claim 10, wherein said compacted region is compacted more than 1%.

13. The method of claim 10, wherein said floor panels have a lower surface; said substrate adjacent said lower surface being undeformed.

14. The method of claim 1, wherein said synthetic material is a thermo-setting resin.

15. The method of claim 1, wherein said top layer has a nominal thickness D3 and said embossed portions of said second relief have a depth D2; said depth D2 being larger than said nominal thickness D3 of said top layer.

16. The method of claim 2, wherein said substantial part of said upper surface over which said decor extends comprises said embossed portions of said second relief.

17. The method of claim 2, wherein said floor panels are of the Direct Pressure Laminate (DPL) type and wherein during said first press treatment said top layer is provided on said substrate.

18. The method of claim 2, wherein said second press treatment is a heated press treatment.

19. The method of claim 2, wherein said second relief includes embossed portions forming a sunk edge area located at least at one of said two opposite edges.

20. The method of claim 19, wherein said sunk edge area comprises a sloping portion.

21. The method of claim 19, wherein said sunk edge area comprises a sloping bent portion.

22. The method of claim 2, wherein said substrate consists of MDF or HDF.

23. The method of claim 2, wherein said substrate comprises a compacted region located at said embossed portions of said second relief.

24. The method of claim 23, wherein said substrate comprises locations without embossments; said compacted region being compacted more than said locations without embossments.

25. The method of claim 23, wherein said compacted region is compacted more than 1%.

26. The method of claim 23, wherein said floor panels have a lower surface; said substrate adjacent said lower surface being undeformed.

27. The method of claim 23, wherein said synthetic material is a thermo-setting resin.

28. The method of claim 2, wherein said top layer has a nominal thickness D3 and said embossed portions of said second relief have a depth D2; said depth D2 being larger than said nominal thickness D3 of said top layer.

29. Method for manufacturing floor panels; said floor panels having an upper surface and at least comprising:

a printed decor extending over a substantial part of said upper surface; and a top layer on the basis of synthetic material;

a substrate whereupon said printed decor and said top layer are provided; said substrate having at least two opposite edges along the upper surface; wherein said floor panels are manufactured starting from boards; said boards at least comprising said substrate; wherein said method at least comprises the step of applying the printed decor on the substrate with the printed decor extending to the opposite edges and then providing said floor panels with a final relief; said step at least including a first press treatment and a second press treatment; said first press treatment providing a first relief in said upper surface; said first relief comprising embossments extending exclusively in said top layer; said second press treatment providing a second relief in said upper surface; said second relief comprising embossed portions which continue up into the aforementioned substrate;

wherein the first and second press treatments are performed separately from one another;

wherein the printed decor continuously extends over and along the embossed portions of the second relief so as to follow the contours of the embossed portions.

30. Method for manufacturing floor panels; said floor panels having an upper surface and at least comprising:

a printed decor extending over a substantial part of said upper surface; and a top layer on the basis of synthetic material;

a substrate whereupon said printed decor and said top layer are provided; said substrate having at least two opposite edges; wherein said floor panels are manufactured starting from boards; said boards at least comprising said substrate; wherein said method at least comprises the step of providing said floor panels with a final relief; said step at least including a first press treatment and a second press treatment; said first press treatment providing a first relief in said upper surface; said first relief comprising embossments extending exclusively in said top layer; said second press treatment providing a second relief in said upper surface; said second relief comprising embossed portions which continue up into the aforementioned substrate;

wherein the first and second press treatments are performed separately from one another;

wherein the printed decor continuously extends over and along the embossed portions so as to follow the contours of the embossed portions;

wherein said substrate comprises a compacted region located at said embossed portions of said second relief;

wherein said compacted region is compacted more than 1%.

* * * * *